US008038031B2

(12) United States Patent
DePietro et al.

(10) Patent No.: US 8,038,031 B2
(45) Date of Patent: Oct. 18, 2011

(54) PORTABLE MANWAY COVER HINGE DEVICE

(75) Inventors: Edward A. DePietro, Manchester, NH (US); James J. Porebski, Tonawanda, NY (US)

(73) Assignee: Universal Hinge Corporation, Manchester, NH (US)

( * ) Notice: Subject to any disclaimer, the term of this patent is extended or adjusted under 35 U.S.C. 154(b) by 465 days.

(21) Appl. No.: 12/102,109

(22) Filed: Apr. 14, 2008

(65) Prior Publication Data

US 2008/0256753 A1 Oct. 23, 2008

Related U.S. Application Data

(63) Continuation-in-part of application No. 11/736,198, filed on Apr. 17, 2007.

(51) Int. Cl.
*B65D 43/16* (2006.01)
*B65D 51/04* (2006.01)

(52) U.S. Cl. ..... 220/845; 220/848; 16/382; 16/387

(58) Field of Classification Search ..... 220/812, 220/845, 848, 817, 644; 16/382, 387, 233, 16/248; 49/236

See application file for complete search history.

(56) References Cited

U.S. PATENT DOCUMENTS

| | | | | |
|---|---|---|---|---|
| 0,510,300 | A | | 12/1893 | Stillwell |
| 0,971,686 | A | | 10/1910 | Michael el al. |
| 1,256,688 | A | | 2/1918 | Hall |
| 2,941,236 | A | * | 6/1960 | Monroe et al. ..... 16/368 |
| 3,119,512 | A | * | 1/1964 | Foster ..... 220/817 |
| 3,454,184 | A | * | 7/1969 | Halpin ..... 220/327 |
| 3,559,838 | A | | 2/1971 | Bow |
| 3,665,958 | A | | 5/1972 | Dunkelis |
| 3,721,363 | A | * | 3/1973 | Bressler et al. ..... 220/315 |
| 4,080,998 | A | | 3/1978 | Mottola et al. |
| 4,141,109 | A | * | 2/1979 | Farrell ..... 16/237 |
| 4,286,727 | A | * | 9/1981 | Limoncelli ..... 220/244 |
| 4,297,072 | A | | 10/1981 | Shah et al. |
| 4,398,649 | A | | 8/1983 | Labbe |
| 4,456,135 | A | | 6/1984 | Beekes |
| 4,504,535 | A | * | 3/1985 | Snyder ..... 428/137 |
| 4,519,519 | A | | 5/1985 | Meuschke et al. |
| 4,655,365 | A | * | 4/1987 | Miller ..... 220/314 |
| 4,664,586 | A | | 5/1987 | Vassalotti |
| 4,669,628 | A | | 6/1987 | Hatta |
| 4,865,513 | A | | 9/1989 | Norris |
| 5,038,520 | A | | 8/1991 | Amorese et al. |
| 5,050,628 | A | | 9/1991 | Ripley et al. |
| 5,056,673 | A | | 10/1991 | Williams |

(Continued)

FOREIGN PATENT DOCUMENTS

| | | | |
|---|---|---|---|
| GB | 2282422 | A | 4/1995 |

(Continued)

*Primary Examiner* — Anthony Stashick
*Assistant Examiner* — Niki Eloshway
(74) *Attorney, Agent, or Firm* — Robert R Deleault, Esq.; Mesmer & Deleault, PLLC

(57) ABSTRACT

A portable manway hinge device has a pair of hinge plates where each hinge plate has a support member with a hinge aperture positioned for alignment with a bolt opening of a manway cover and a manway flange, a linkage member adjacent a first end of each hinge plate and extending out of the plane of the hinge plate, and a pivotal connection coupling overlapping pairs of the linkage member of the pair of hinge plates.

27 Claims, 18 Drawing Sheets

U.S. PATENT DOCUMENTS

| | | | | |
|---|---|---|---|---|
| 5,092,963 | A | 3/1992 | Barker et al. | |
| 5,184,422 | A | 2/1993 | Wade et al. | |
| 5,228,825 | A | 7/1993 | Fruchtbaum et al. | |
| 5,327,684 | A * | 7/1994 | Herbst | 49/506 |
| 5,394,650 | A | 3/1995 | Dean | |
| 5,403,053 | A | 4/1995 | Zareck | |
| 5,431,248 | A | 7/1995 | Willaughby | |
| 5,617,963 | A | 4/1997 | Baziuk et al. | |
| 6,129,225 | A | 10/2000 | Giannoglou et al. | |
| 6,786,343 | B1 * | 9/2004 | Porebski et al. | 212/179 |
| 7,556,160 | B2 * | 7/2009 | Porebski et al. | 212/179 |
| 2004/0108660 | A1 * | 6/2004 | Frew et al. | 277/628 |
| 2005/0242051 | A1 | 11/2005 | Porebski et al. | |
| 2006/0059662 | A1 * | 3/2006 | Roeper | 16/382 |
| 2006/0219649 | A1 | 10/2006 | Wolfford, Sr. | |

FOREIGN PATENT DOCUMENTS

| | | | |
|---|---|---|---|
| JP | 06024490 | A | 2/1994 |
| JP | 2000313495 | A | 11/2000 |

* cited by examiner

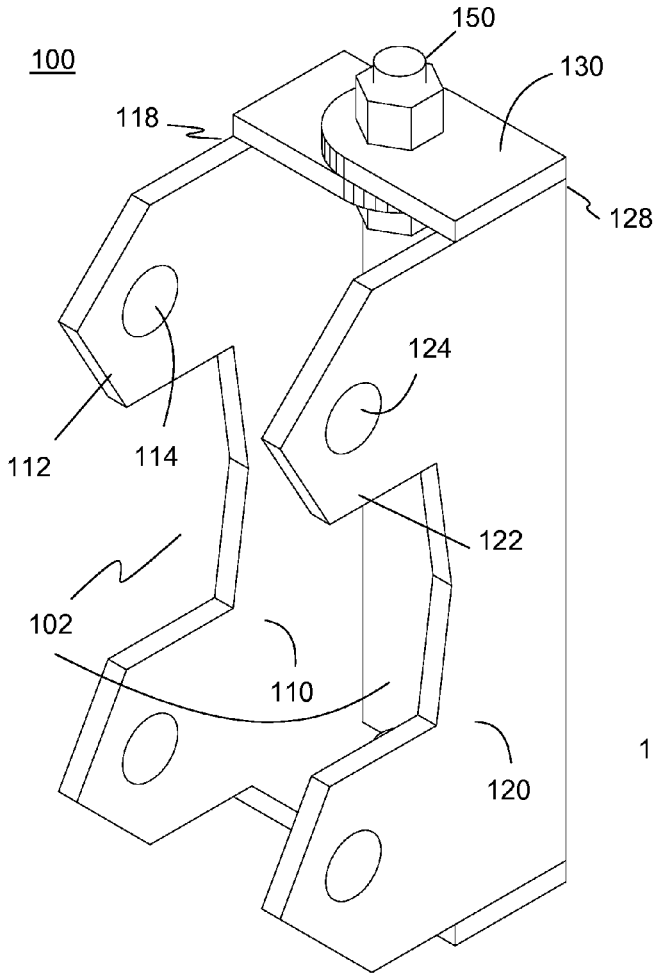
Fig. 15A
Fig. 15B
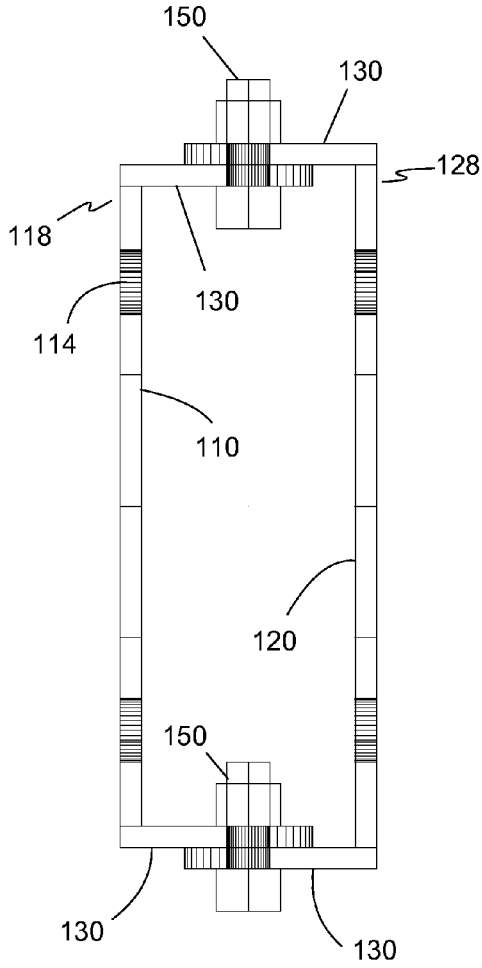

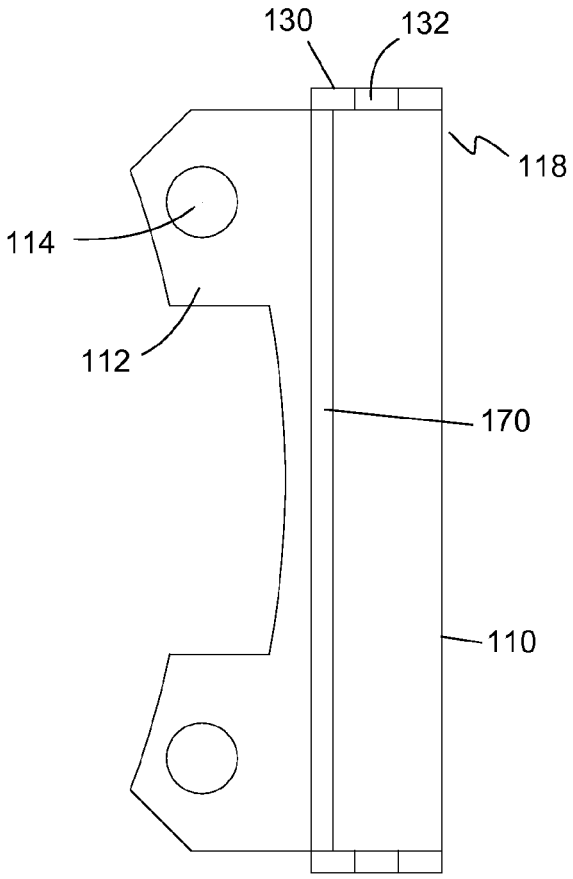
Fig. 18A
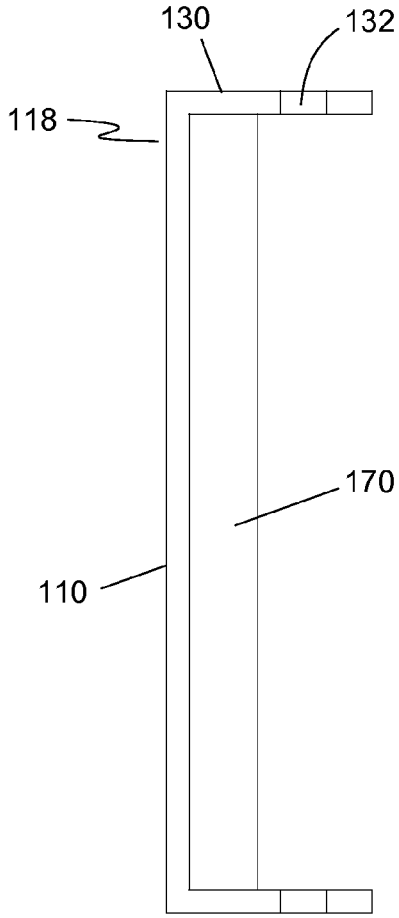
Fig. 18C
Fig. 18B
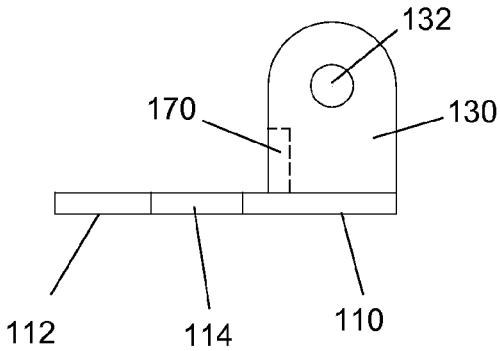

PORTABLE MANWAY COVER HINGE DEVICE

This application is a Continuation-in-Part Application of Ser. No. 11/736,198, filed on Apr. 17, 2007.

BACKGROUND OF THE INVENTION

1. Field of the Invention

The present invention relates generally to "manway" covers for access to enclosed spaces such as tanks, conduits, storage areas, heat exchanger tubes. Particularly, the present invention relates to mechanisms to assist in the removal of "manway" covers. More particularly, the present invention relates to mechanisms for handling the removal and installation of "manway" covers that are too heavy to be handled by an unaided individual.

2. Description of the Prior Art

Manway covers are typically large, heavy, metal plates that are bolted to an opening. For purposes of the present invention, the definition of "manway covers" expressly means any heavy covers or closures used on pressure vessels, vacuum vessels, atmospheric vessels, heat exchangers, heat exchanger channel covers, heat exchanger channels, heat exchanger bonnets, heat exchanger shell covers, dished heads, domed heads, half covers such as on divided water box heat exchangers, chiller condensers, chiller heat exchangers, chiller coolers, inspection ports, or any type of blanking plate and is not construed to be limited to only covers used on openings that are dimensionally-sized to allow passage of a man. The most common are circularly-shaped and mate to a flange by way of a plurality of bolts evenly spaced around the periphery of the opening. However, it should be understood that the heavy covers may be any shape. The defined manway covers typically provide access to enclosed spaces such as tanks, conduits, storage areas, transfer tubes, pressure vessels, vacuum vessels, atmospheric vessels, heat exchangers, heat exchanger channel covers, heat exchanger channels, heat exchanger bonnets, and the like. These types of covers are typically found in power plants, co-generation power plants, steam generation plants, chemical plants, petrochemical plants, refineries, pharmaceutical plants, air separation plants, beverage plants, food processing plants, heating and cooling facilities, buildings with central heating and cooling systems, buildings with chiller cooling systems, water treatment plants, waste management plants, dairies, tank farms, gas storage facilities, liquid natural gas storage facilities, manufacturing facilities and or any facility that has tanks, vessels, piping, heat exchangers, chillers, boilers, turbines and/or equipment of similar nature.

Routine servicing and inspection requirements as well as other operating conditions necessitate periodic removal of these covers. In view of the typical location and weight of the covers, it is not a simple task to remove the cover or to re-install the same. Removal is currently accomplished with the use of hand operated davit swing arms, chain falls, ratchet hoists, and brute force. Except for davit swing arms, it is necessary during the removal process to lower the covers a distance to a level surface.

Various devices have been devised to facilitate manway cover removal and re-installation. U.S. Patent Application Publication 2005/0242051 (2005, Porebski et al.) discloses a removable cover support system having a base member and a securing mechanism slidably insertable through at least one of a cover flange hole of a cover assembly, a retaining sleeve connected to the securing base assembly, a swingarm assembly rotatably supported by the retaining sleeve, and a lifting mechanism connected to the swingarm assembly.

U.S. Pat. No. 4,519,519 (1985, Meuschke et al.) discloses a davit assembly that is connected with a transfer tube and a hatch cover to move the cover away. The davit assembly, which is a swingarm, is permanently attached to the outside of the transfer tube.

U.S. Pat. No. 4,297,072 (1981, Shah et al.) discloses a manway handling apparatus having a support arm pivotally mountable on equipment having elliptical manway access openings. The support arm when mounted is swingable toward and away from an access opening and carries a bearing block supporting bracket which is longitudinally adjustably positionable on the arm. The bearing block is vertically adjustably positionable in the bracket and slidably supports a shaft which is attachable to an elliptical cover. The shaft carries structure means which when actuated by turning of a crank handle is effective for tilting the cover and to facilitate its installation and removal.

U.S. Pat. No. 4,865,513 (1989, Norris) discloses a portable manway cover handling apparatus. A boom is mounted within a sleeve for longitudinal translation and the sleeve is hinged to a base plate that is securable by a C-clamp to a superstructure beam in front of a manway cover. A hydraulic actuator bears against the sleeve to adjust its elevation. A powered cable winch is joined to one end of the boom and its cable passes through the boom, which is hollow to the opposite end, and about a pulley to a fastener for attachment to an eye secured in the upper edge of the manway cover. A presser foot is hydraulically actuated to bear against the manway cover with the cable attached to the cover so that the bolts holding the cover in place can be removed. Guide pins are provided for installation in the mounting flange to pilot the cover into registration with the bolt holes when the cover is to be mounted rather than demounted.

The prior art devices suffer from various disadvantages. The swingarm devices are bulky and comprise multiple parts for removably attaching the assembly to the manway or the swingarms are permanently attached to the manway. Other devices are also large, bulky and complicated structures using a boom that requires the base plate of the device to be secured by a C-clamp to a superstructure beam.

Therefore, what is needed is a manway cover handling device that is compact and portable. What is also needed is a manway cover handling device that is easy to attach and remove from a manway only when the manway cover needs to be removed. What is further needed is a manway cover handling device that is relatively lightweight compared to prior art devices. What is still further needed is a manway cover handling device that is simple to assemble.

SUMMARY OF THE INVENTION

It is an object of the present invention to provide a portable manway cover hinge device that can be quickly and easily installed to remove and/or install, support, and/or store a manway cover. It is another object of the present invention to provide a portable manway cover hinge device that can be used in confined or congested areas to remove and/or install, support, and/or store a manway cover. It is a further object of the present invention to provide a portable manway cover hinge device that does not require its use from the floor to remove and/or install, support, and/or store a manway cover. It is still another object of the present invention to provide a portable manway cover hinge device that is portable and that can be used as required in different locations to remove and/or install, support, and/or store a manway cover. It is yet another object of the present invention to provide a portable manway cover hinge device that one man can handle and install for removing and/or installing, supporting, and/or storing a manway cover.

It is another object of the present invention to provide a portable manway cover hinge device that does not require welding for installation. Given that welding to some equipment structures (pressure vessels and the like) may adversely affect the integrity/reliability of the equipment structure, or re-certification of the equipment structure.

It is a further object of the present invention to provide a portable manway cover hinge device that may be used on non-ferrous and/or non-metallic structures having a manway cover. Since many equipment structures are constructed of non-metallic materials such as Fiberglas™ or other composite materials, a method of manipulating a manway cover in this environment is highly desirable.

It is still a further object of the present invention to provide a portable manway cover hinge device that is relatively universal and can be used on manway covers of various sizes.

The present invention achieves these and other objectives by providing a portable manway hinge device. In one embodiment, the manway hinge device includes a pair of elongated hinge members where each hinge member has a pair of longitudinally-aligned, elongated apertures, a support member slidably connected to each of the elongated apertures where the support member has a pin receiving end, and a linkage member privotally connected to each of the pair of elongated hinge members. An optional pin may be provided or the manway cover bolts may be used as the pins for securing the support members to the manway cover and flange.

For manways having split covers, the present invention also includes an optional component for using two portable manway hinge devices. In one embodiment, the optional component is a hinge connector that connects one hinge member of one hinge device to a serially-aligned hinge component of an adjacent hinge device. The hinge connector may be attached between the two serially aligned hinge components using alignment pins, threaded rods, securing brackets, and the like. In another embodiment, the optional component is a leveling member connected at or adjacent one end of the hinge device. The leveling member on the flange hinge member may be aligned for contact with the peripheral edge of the flange or with the manway extension connected to the flange. The leveling member on the cover hinge member is aligned for contact with the peripheral edge of the cover.

In another embodiment, the portable manway hinge device includes a pair of hinge plates having a plurality of support members where each support member has a hinge aperture adjacent a first side edge of each of the hinge plates, a linkage member adjacent each end of the hinge plates and extending out of the plane of the hinge plate adjacent a second side edge of each of the hinge plates, and a pivotal connection coupling overlapping pairs of the linkage members of the pair of hinge plates. The pivotal connection may be a pivotal pin that is inserted into a linkage aperture in each pair of overlapping linkage members or it may be a single pivotal pin that extends and couples each overlapping pair of linkage members associated with a hinge device. Additionally, the linkage members of each of the pair of hinge plates may be nested or offset. Each hinge plate may optionally include a plate stiffener. In one embodiment, the plate stiffener extends out of the plane of the hinge plates between the linkage members to reinforce the hinge plate and the linkage members. In another embodiment, the plate stiffener extends out of the plane of the hinge plates on a side opposite the linkage members and further extends over the outside surface of the linkage member to also reinforce the hinge plate and the linkage members. The linkage member can be a plate with a linkage aperture or a rod with one end attached to the hinge plate and the other end with a linkage pin receiving aperture. The plurality of hinge plate apertures are spaced to align with the bolt holes of the manway cover to which the hinge device attaches.

In still another embodiment, the portable manway hinge device includes a pair of hinge plates containing a plurality of hinge apertures adjacent a first side edge of each of the hinge plates, a pair of linkage members having a linkage member tab extending away from a linkage member body where the linkage member tab extends through a linkage member slot in the hinge plate, and optional adjustment spacers mountable between the linkage member body of the removable linkage member and the side of the hinge plate. The optional adjustment spacers allow attachment of the hinge device to a wide variety of cover and flange thicknesses.

In yet another embodiment, the portable manway hinge device of any of the previous embodiments has a pair of hinge plates where one of the plurality of hinge apertures adjacent a first side edge of the hinge plates is a hinge attachment slot. The slot is used to accommodate the difference in vertical spacing of the bolt holes in a cover and a flange as well as the vertical spacing where a cover's bolt holes are spaced differently than the flange bolt holes.

In another embodiment, the portable manway hinge device is a split hinge device that includes an upper hinge support and a lower hinge support. Each of the upper hinge support and the lower hinge support has a pair of split hinge plates with at least a linkage member at one end of each of the split hinge plates and a pivotal connection coupling overlapping pairs of the linkage members of each of the pair of split hinge plates. The pivotal connection may be a pivotal pin for each pair of overlapping linkage members or it may be a single pivotal pin that extends and couples each overlapping pair of linkage members associated with the split hinge device. The linkage members of each of the pair of split hinge plates may be nested or offset. Each hinge plate may optionally include a plate stiffener, as previously disclosed.

In all embodiments of the present invention, an optional pin may be provided or the manway cover bolts may be used as the pins for securing the support members to the manway cover and flange. The pin may be threaded, tapered, unthreaded rods and/or bolts, expanding plugs, and the like.

By using the bolt holes on the cover and cover flange, one of the main advantages of the present invention is that the present invention does not require welding of the hinge device to the equipment with the removable cover.

BRIEF DESCRIPTION OF THE DRAWINGS

FIG. 15A is a perspective view of another embodiment of the present invention showing the major components of the hinge device.

FIG. 15B is a front view of the embodiment in FIG. 15A.

FIGS. 18A, 18B and 18C are a side view, an end view and a rear view, respectively, of the hinge plate of the embodiment in FIG. 15A showing an internal plate stiffener.

DETAILED DESCRIPTION OF THE PREFERRED EMBODIMENT

Figure 1:
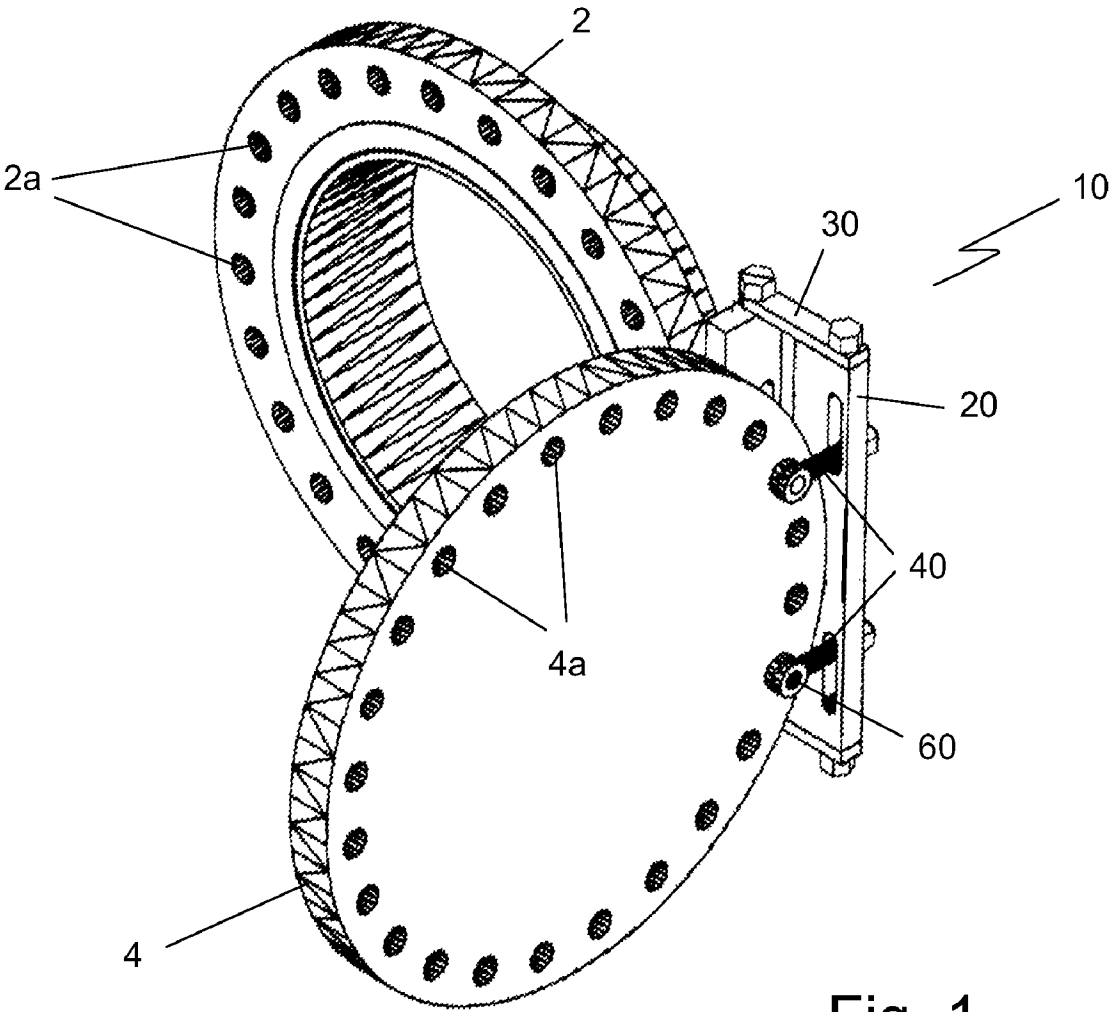
FIG. 1 is a perspective view of one embodiment of the present invention attached to a manway flange and manway cover showing the manway cover in an open and supported position.

The preferred embodiment(s) of the present invention is illustrated in FIGS. 1-24. FIG. 1 illustrates the use of a portable manway cover hinge device 10 on a manway. Hinge device 10 includes a pair of elongated hinge members 20, a linkage member 30 and a plurality of support members 40. One of the elongated hinge members 20 is connected to a manway cover flange 2 and the other of the elongated hinge members 20 is connected to the peripheral edge of manway cover 4. Linkage member 30 is pivotally connected to the pair of elongated hinge members 20 and configured to swing manway cover 4 away from manway opening 6 providing access to the inside of the manway structure. A plurality of pins 60 secure a plurality of support members 40 to a plurality of bolt holes 2*a* and 4*a* in manway flange 2 and manway cover 4, respectively.

Figure 2:
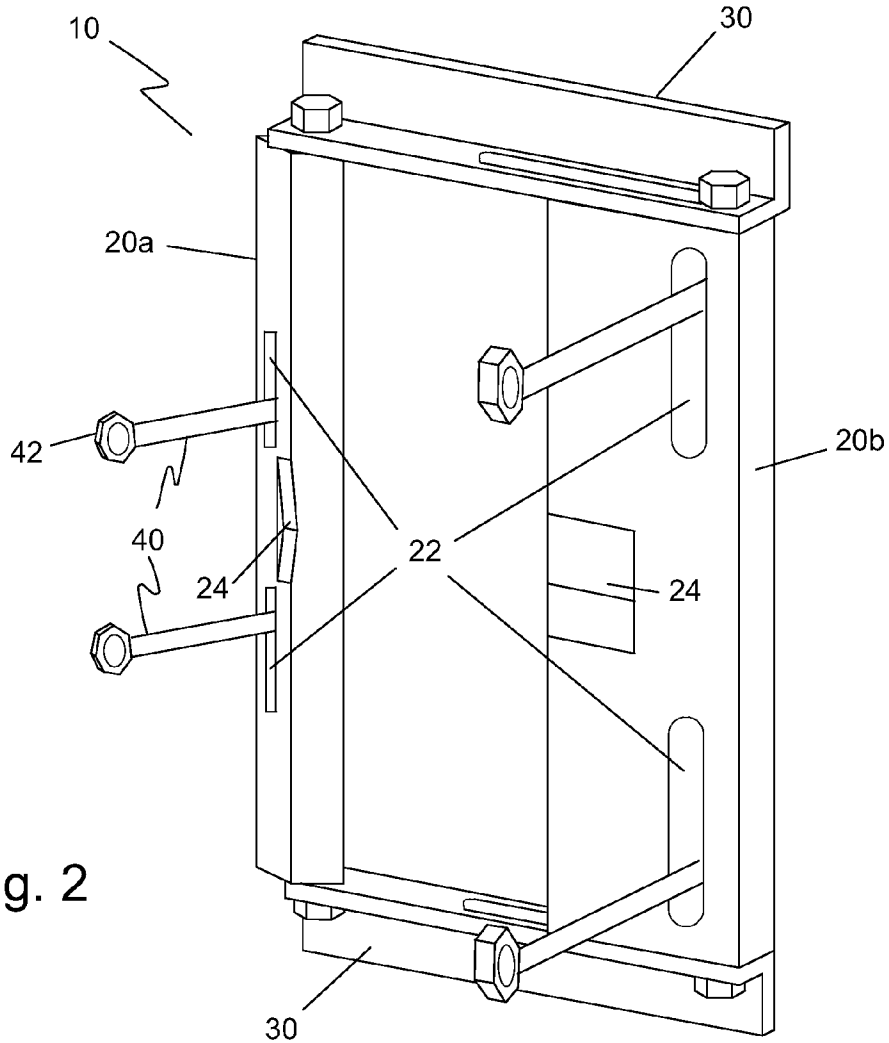
FIG. 2 is a perspective view of the present invention showing the major components of the hinge device.

FIG. 2 illustrates the portable manway cover hinge device 10. Hinge device 10 includes a pair of elongated hinge members 20 comprising a flange hinge member 20*a* and a cover hinge member 20*b*. A linkage member 30 connects flange hinge member 20*a* to cover hinge member 20*b* at each end. Linkage member 30 maintains the proper spacing between the elongated hinge members 20 while being configured to pivot the pair of elongated hinge members 20 relative to each other. The elongated hinge members 20 each have a pair of longitudinally-aligned apertures 22 therethrough. Each longitudinally-aligned aperture 22 has a support member 40 received therethrough for connecting the hinge device 10 to the manway flange 2 and the manway cover 4. Support member 40 has a pin receiving end 42 that is used for connecting to manway flange 2 and manway cover 4. As can be seen from FIG. 2, flange hinge member 20*a* and cover hinge member 20*b* have an optional recessed portion 24 in the surface of the members 20*a*, 20*b* positioned approximately at the middle of hinge members 20 inward from a longitudinal edge that is furthest from the longitudinally-aligned apertures 22.

Figure 3:
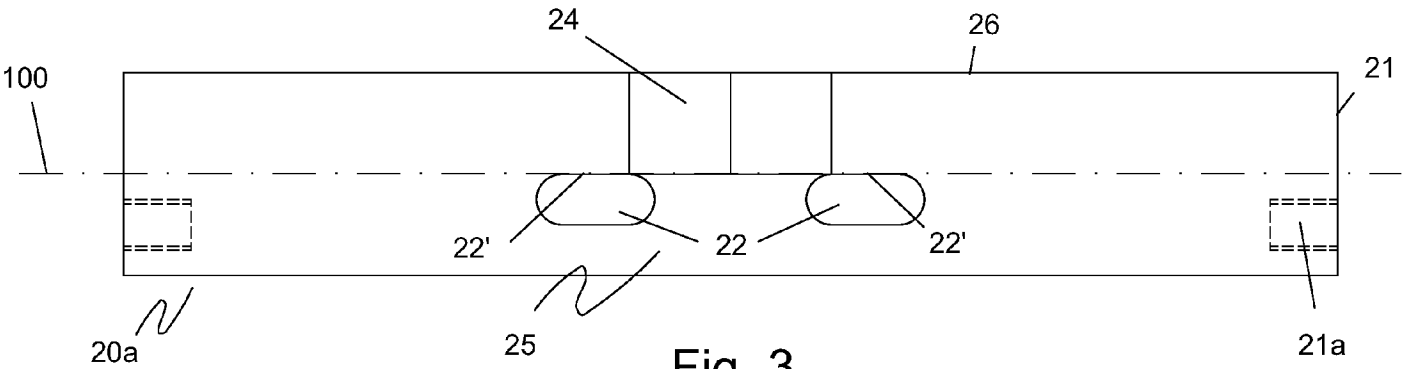
FIG. 3 is a front view of one embodiment of the elongated hinge member of the present invention showing the longitudinally-aligned, elongated apertures located within a central portion of the hinge member.

FIG. 3 is a front view of flange hinge member 20*a*. Flange hinge member 20*a* has longitudinally-aligned apertures 22 preferably positioned within a central portion 25 of flange hinge member 20*a* where one of the elongated sides 22' of apertures 22 are located along a longitudinal center line 100 of flange hinge member 20*a*. Apertures 22 are spaced from each other to provide adjustability for use on manway covers of different sizes, which typically would have different spacing between radial cover bolt locations depending on the size of the manway cover. The elongated apertures 22 are configured to adjust for the difference in distance between the bolts of the cover 4. Optional recessed portion 24 is located in central portion 25 on the opposite side of longitudinal center line 100 from apertures 22. Preferably, recessed portion 24 is contiguous to member edge 26. Each hinge member end 21 has an end recess 21 a for receiving a fastener that connects linkage member 30 (not shown) to flange hinge member 20*a*.

Figure 4:
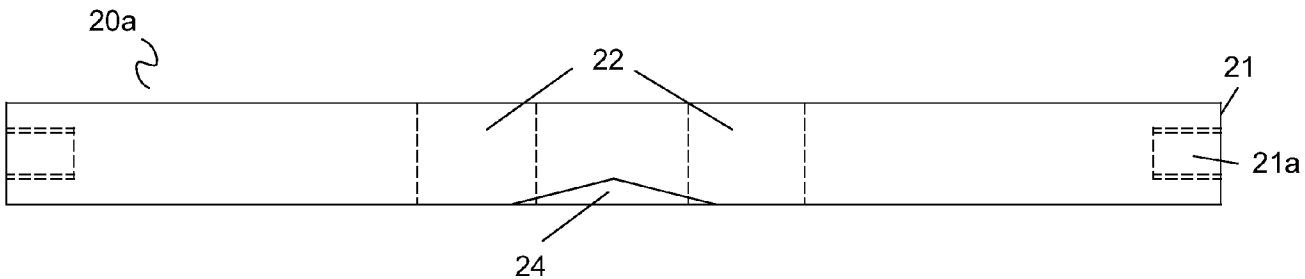
FIG. 4 is a side view of the elongated hinge member shown in FIG. 3.
Figure 5:
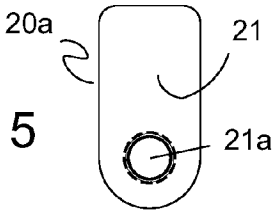
FIG. 5 is an end view of the elongated hinge member shown in FIG. 3.

FIG. 4 is a side view showing optional recessed portion 24. As illustrated, optional recessed portion 24 is V-shaped but could also be any shape that provides a surface for positioning against the peripheral edge of the manway flange 2 or cover 4. Apertures 22 pass completely through flange hinge member 20*a* and are elongated to provide spacing for longitudinal adjustment of a support member 40 (not shown). FIG. 5 is an end view of flange hinge member 20*a* showing the end recess 21*a*. End recess 21*a* is preferably a threaded recess but may, in the alternative, be configured for a removable compression fitting.

Figure 6:
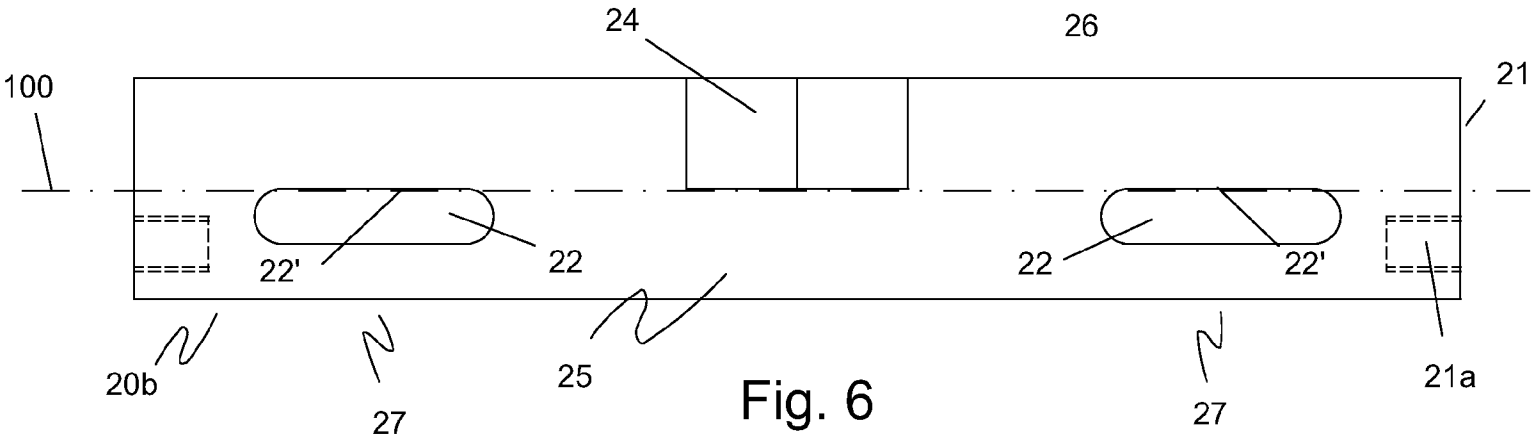
FIG. 6 is a front view of another embodiment of the elongated hinge member of the present invention showing the longitudinally-aligned, elongated apertures locate within the end portion of the hinge member.

FIG. 6 is a front view of cover hinge member 20*b*. Cover hinge member 20*b* has longitudinally-aligned apertures 22 preferably positioned within an end portion 27 of cover hinge member 20*b* where one of the elongated sides 22' of apertures 22 are located along a longitudinal center line 100 of flange hinge member 20*b*. Apertures 22 are spaced from each other to not only provide adjustability for use on manway covers of different sizes, but also to provide better support for manway cover 4 and prevent inadvertently aligning a support member 40 of cover hinge member 20*b* with a support member 40 of flange hinge member 20*a*. Like elongated apertures 22 in flange hinge member 20*a*, the elongated apertures 22 of cover hinge member 20*b* are configured to adjust for the difference in distance between the bolts of the cover 4. Cover hinge member 20*b* may also have optional recessed portion 24. Optional recessed portion 24 is located in central portion 25 on the opposite side of longitudinal center line 100 from apertures 22. Preferably, recessed portion 24 is contiguous to member edge 26. Each hinge member end 21 has an end recess 21*a* for receiving a fastener that connects linkage member 30 (not shown) to cover hinge member 20*b* and may be configured to receive a fastener as are known to those skilled in the art to support attachment with linkage membe 30.

Figure 7:
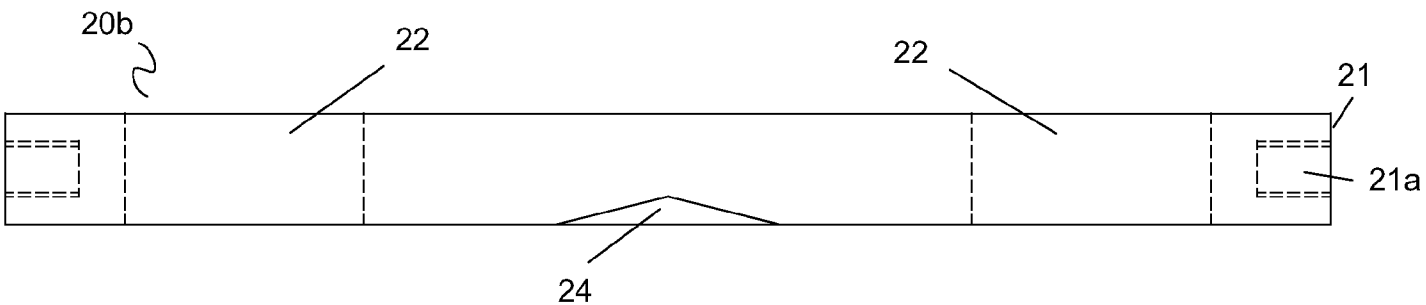
FIG. 7 is a side view of the elongated hinge member shown in FIG. 6.
Figure 8:
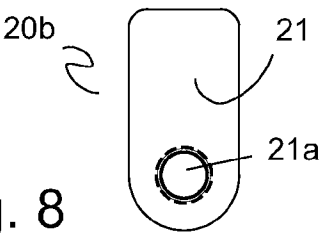
FIG. 8 is an end view of the elongated hinge member shown in FIG. 6.

FIG. 7 is a side view showing optional recessed portion 24. As illustrated, optional recessed portion 24 is V-shaped but could also be any shape that provides a surface for positioning against the peripheral edge of the manway cover 4. Apertures 22 pass completely through cover hinge member 20*b* and are elongated to provide spacing for longitudinal adjustment of a support member 40 (not shown). FIG. 8 is an end view of cover hinge member 20*b* showing the end recess 21*a*. As illustrated in the Figures, flange hinge member 20*a* and cover hinge member 20*b* are similar except for the location of the longitudinally-aligned apertures 22. This simplifies manufacturing of the components and, thus, reduces cost.

Figure 9:
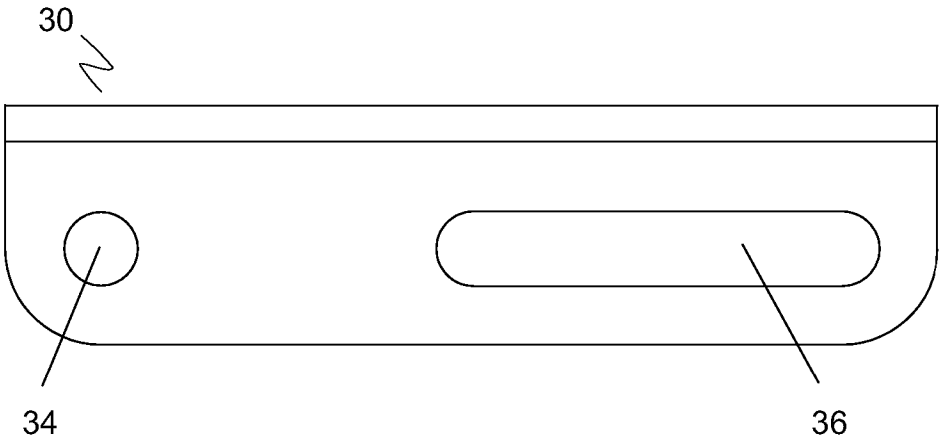
FIG. 9 is a top view of one embodiment of the linkage member of the present invention showing an adjustment slot.

Turning now to FIG. 9, there is illustrated a top plan view of linkage member 30. Linkage member 30 has a first linkage aperture 34 near one end and a second linkage aperture 36 near the opposite end. Second linkage aperture 36 is preferably an elongated slot, which provides a mechanism for adjusting the distance between flange hinge member 20*a* (not shown) and cover hinge member 20*b* (not shown) depending on the size/thickness of the manway flange 2 and the manway cover 4. First linkage aperture 34 and second linkage aperture 36 are configured to receive fasteners that attach linkage member 30 to the ends 21 of flange hinge member 20*a* and cover hinge member 20*b*.

Figure 10:
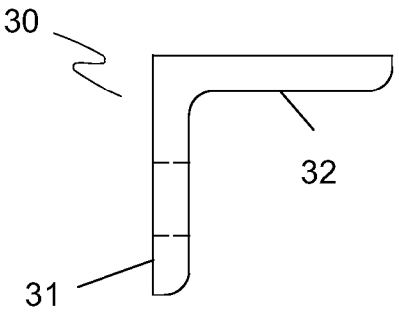
FIG. 10 is an end view of the linkage member shown in FIG. 9.

FIG. 10 is an end view of linkage member 30. FIG. 10 illustrates linkage member 30 as being an L-shaped linkage having a first leg 31 and a second leg 32. It should be noted that linkage 30 may be flat instead of L-shaped or it may be tubular. The purpose of linkage member 30 is to connect flange hinge member 20*a* to cover hinge member 20*b* where hinge members 20*a* and 20*b* are pivotably connected to swing cover 4 away from fange 2.

Figure 11:
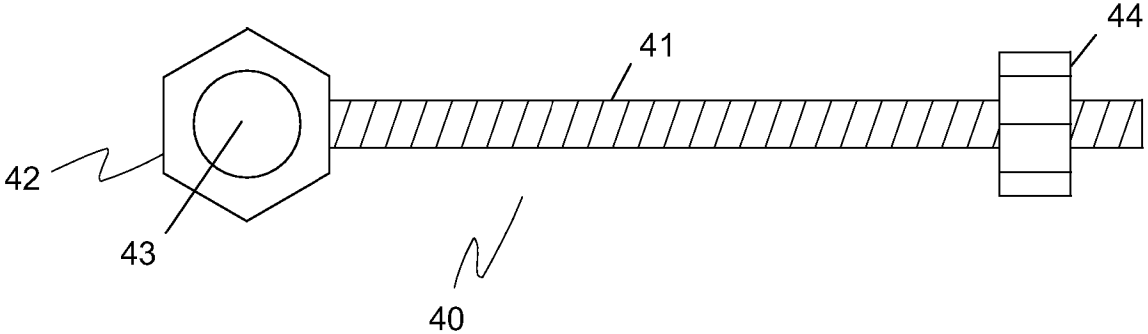
FIG. 11 is a side view of one embodiment of a support member of the present invention showing a pin receiving end.

FIG. 11 is a side view of a support member 40. Preferably, support member 40 has a threaded rod 41 with a pin receiving end 42. Pin receiving end 42 has a pin receiving aperture 43. Optionally, pin receiving aperture 43 may be threaded to accept a bolt similar to the bolts that secure the manway cover 4 to manway flange 2 (or may be the cover bolts themselves). The bolt acts as a pin 60 for connecting support member 40 to the manway flange 2 and manway cover 4. A support member nut 44 is configured for threadable attachment to threaded rod 41 and used to retain support member 40 within the elongated apertures 22 of hinge members 20*a*, 20*b*.

Figure 12:
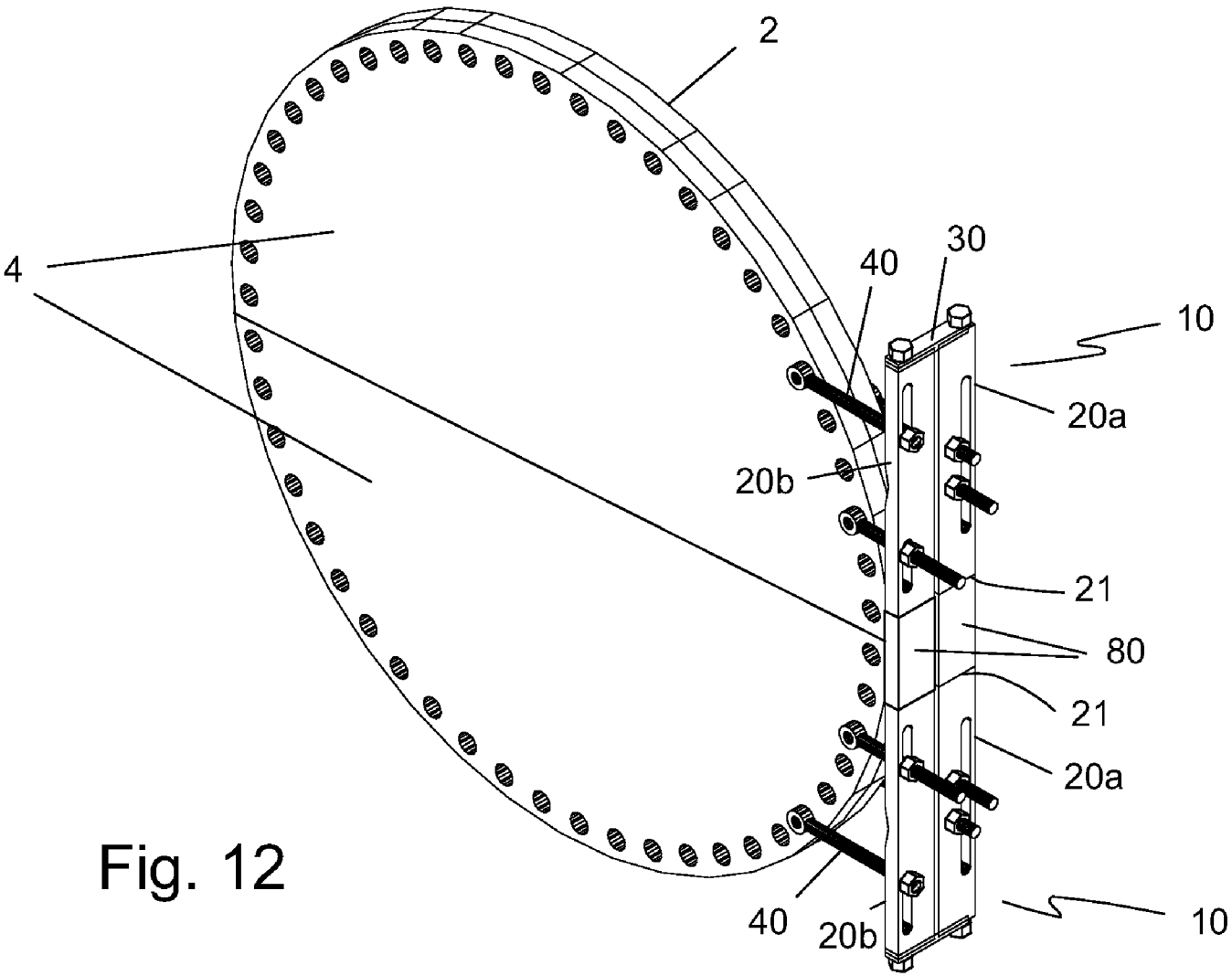
FIG. 12 is a perspective view of another embodiment of the present invention showing a connecting member between a pair of serially aligned hinge devices and mounted on a split manway cover and a manway flange with the cover in the closed position.
Figure 13:
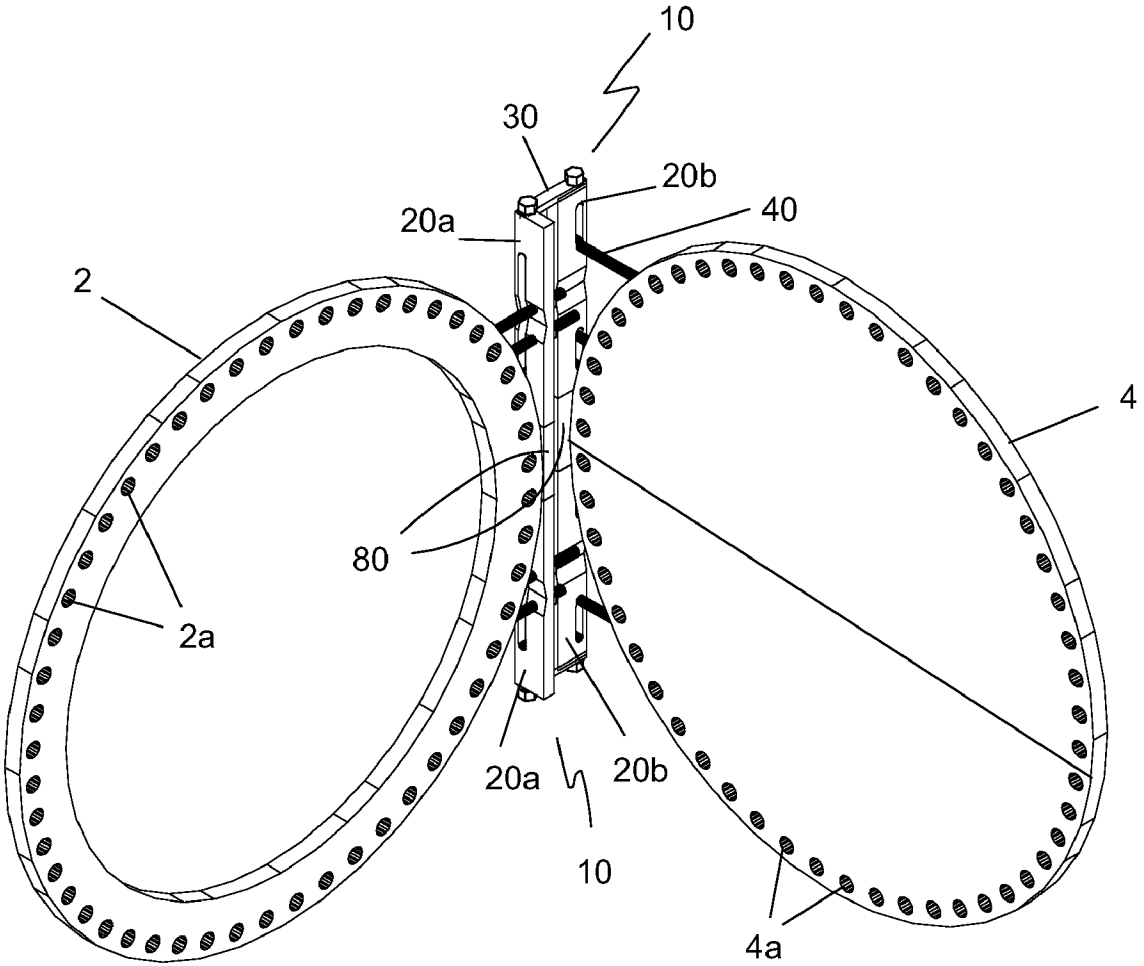
FIG. 13 is a perspective view of the embodiment of the present invention shown in FIG. 12 showing the split manway cover in an open position.

In some situations, a manway cover is a split cover. The present invention may also be used on split manway covers by providing a slight modification to the manway cover hinge device 10. FIG. 12 illustrates one embodiment of such a modification. FIG. 12 shows a manway cover 4 in position against a manway cover flange 2. Two hinge devices 10 are used in this situation. Hinge devices 10 are serially aligned end to end with each other. A hinge connector 80 is removably attached to each end 21 of flange hinge member 20*a* and cover hinge member 20*b* between the two serially aligned hinge devices 10 and provides a surface against which the peripheral edge of manway flange 2 and manway cover 4 make contact. Hinge connector 80 may be connected to hinge devices 10 with alignment pins, threaded rods, tubular brackets, and the like (not shown). FIG. 13 is a perspective view of the embodiment in FIG. 12 showing the manway cover 4 pivotally moved away from manway cover flange 2.

Figure 14:
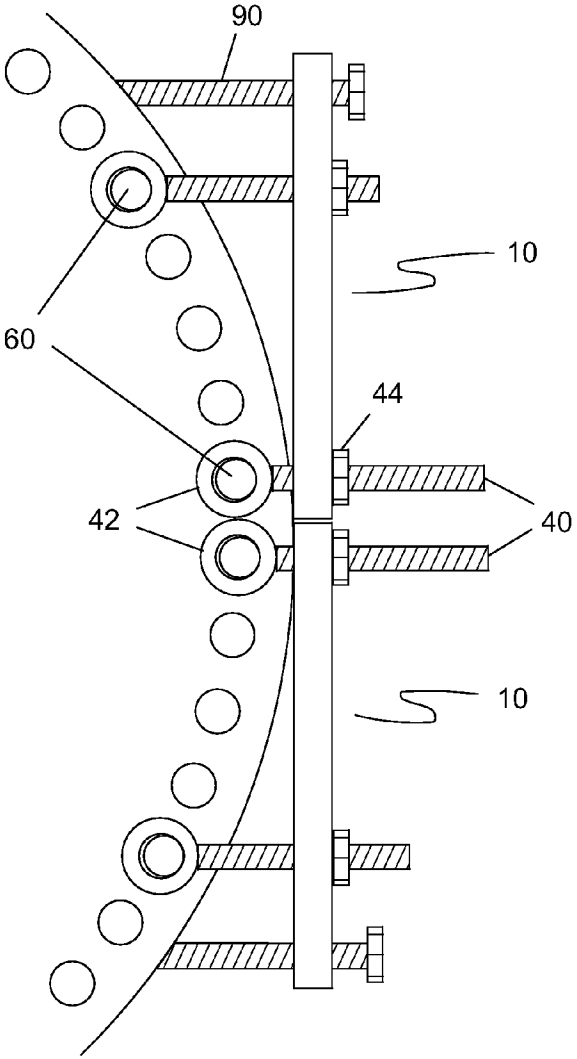
FIG. 14 is a side view of another embodiment of the present invention for use with a split manway cover in a closed position showing the use of a leveling member at or adjacent the end of the elongated hinge member.

FIG. 14 is a side view of another embodiment of the present invention for use with split manway covers. In this embodiment, hinge devices 10 are serially aligned and adjacent to each other but not connected together. Instead, each hinge device has a leveling member 90 attached to an end portion 27 of flange hinge member 20*a* and cover hinge member 20*b*. In the embodiment illustrated in FIG. 14, leveling member 90 is a set screw. Leveling member 90 of flange hinge member 20*a* may contact the peripheral edge of manway flange 2 or to the extension tube (not shown) to which manway flange 2 is attached. In this illustration, there is also shown the use of a pin 60 through the bolt holes of manway cover 4 and manway flange 2. Leveling member 90 of cover hinge member 20*b* preferably contacts the peripheral edge of manway cover 4.

Turning now to FIG. 15A, there is illustrated another embodiment of the present invention showing a portable, manway hinge device 100. Manway hinge device 100 includes a pair of hinge plates 110, 120, a linkage member 130 and a pivot connection 150. Each hinge plate 110, 120 has a support member 112, 122 with a hinge aperture 114, 116, respectively. Hinge aperture 114, 116 are positioned for alignment with a bolt opening of a manway cover and manway flange. It should be noted that if the pre-existing bolt openings in the manway cover and manway flange are unsuitable for use with the present invention, additional bolt openings may be formed into the manway cover and manway flange that are suitable for use with the present invention. Linkage member 130 is adjacent a first hinge plate end 118, 128 of each hinge plate 110, 120 and extends out of the plane of each hinge plate 110, 120. Pivot connection 150 pivotally connects linkage member 130 of hinge plate 110 to linkage member 130 of hinge plate 120, which permits hinge plates 110, 120 to pivot relative to each other. Linkage member 130 may be a bent extension portion of hinge plate 120, integral to hinge plate 120 or a separate component that is welded or otherwise securely attached to hinge plate 120 using fasteners, compression studs, and the like, FIG. 15B is a front view of hinge device 100. This view clearly shows the spatial relationship of hinge plates 110, 120 and linkage members 130. As shown, linkage members 130 of hinge plate 110 are nested within linkage members 130 of plate 120. Alternatively, linkage members 130 may optionally be made for offset assembly where linkage member 130 of hinge plate 110 would be on the inside relative to the adjacent linkage member 130 of hinge plate 120 while the linkage member 130 at the opposite end of hinge plate 110 would be on the outside relative to the adjacent linkage member 130 of hinge plate 120.

Figure 16A:
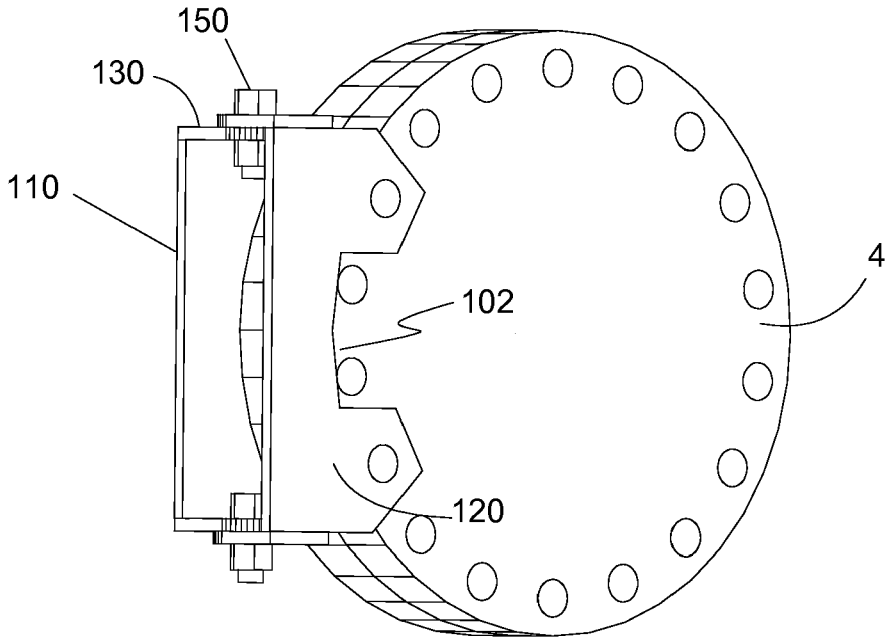
FIG. 16A is a perspective view of the embodiment in FIG. 15A showing the hinge device attached to the manway cover.
Figure 16B:
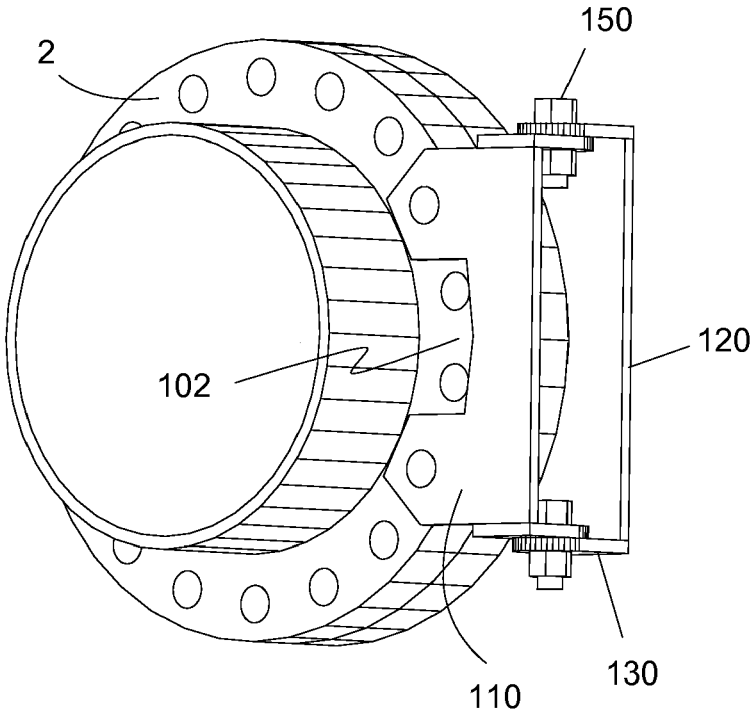
FIG. 16B is a perspective view of the embodiment in FIG. 15A showing the hinge device attached to the manway cover flange.
Figure 16C:
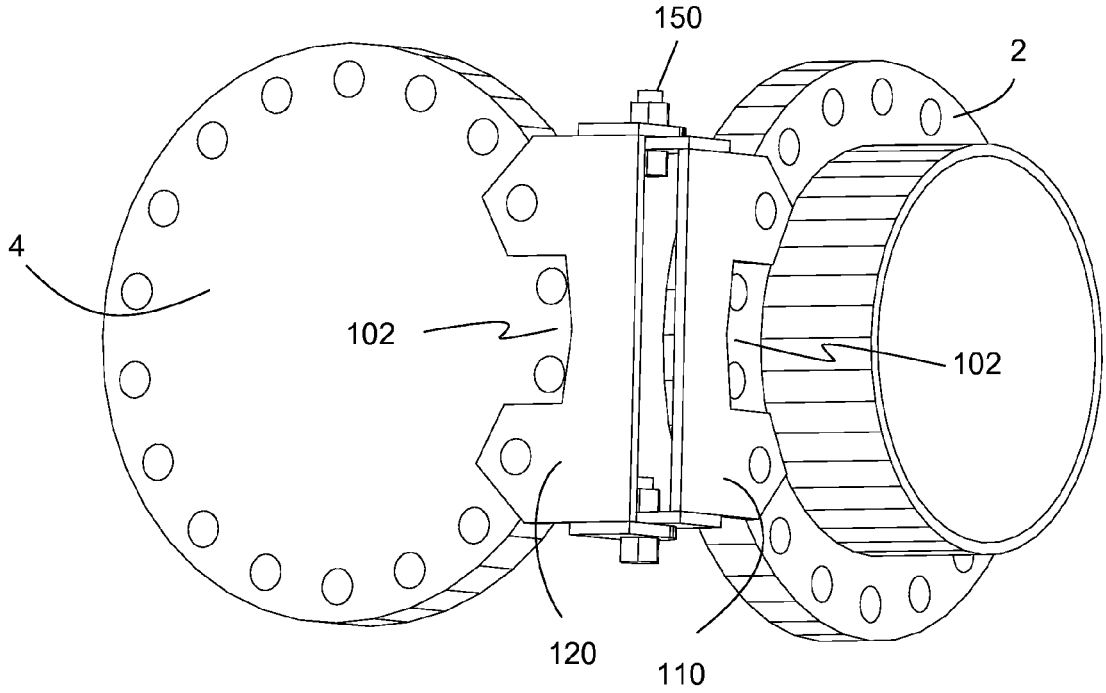
FIG. 16C is a perspective view of the embodiment in FIG. 15A showing the outside of the hinge device supporting a manway cover in an open position relative to the manway and manway flange.

FIGS. 16A, 16B and 16C illustrate hinge device 100 mounted on a manway cover 4 and a manway flange 2 in a closed and open position. FIG. 16A is a perspective cover view of hinge plate 120 attached to cover 4. FIG. 16B is a perspective flange view of hinge plate 110 attached to flange 2. FIG. 16C is an outside perspective view of hinge device 100 where cover 4 is in an open position relative to flange 2. Each of these figures shows an optional feature of hinge device 100. In this embodiment, an optional cutout or notch 102 provides access to cover bolts not originally removed for attaching hinge device 100 to cover 4 and flange 2. An alternative to a cutout or notch 102 is a plurality of apertures that are located in hinge plates 110, 120 that coincide with cover/flange bolts. It should be understood that the size of the plurality of apertures would be sufficiently large to allow access to the cover/flange bolts.

Figure 17A:
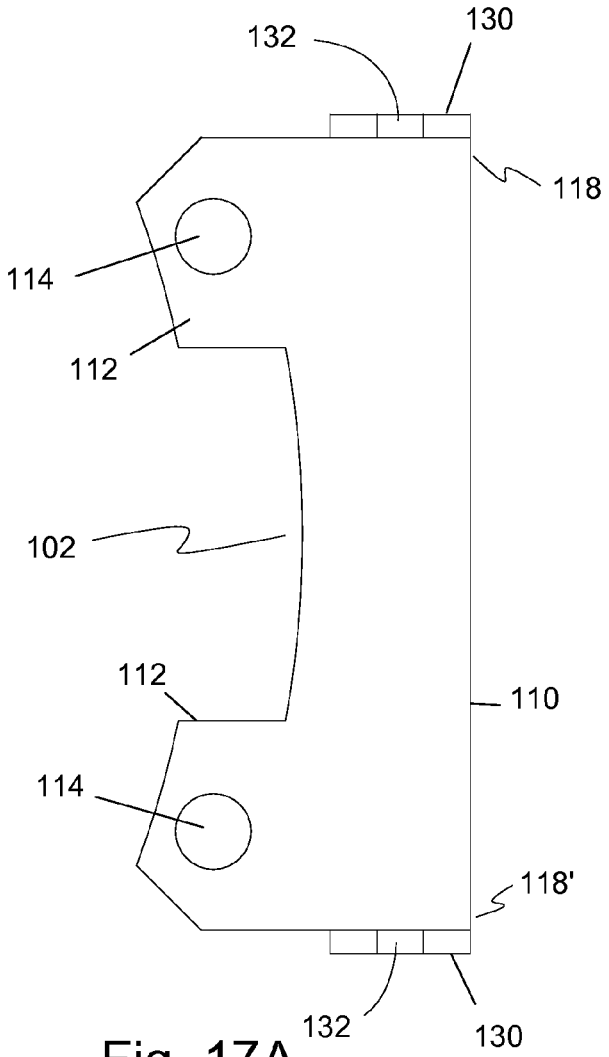
FIG. 17A is a side view of a hinge plate of the embodiment in FIG. 15A.
Figure 17C:
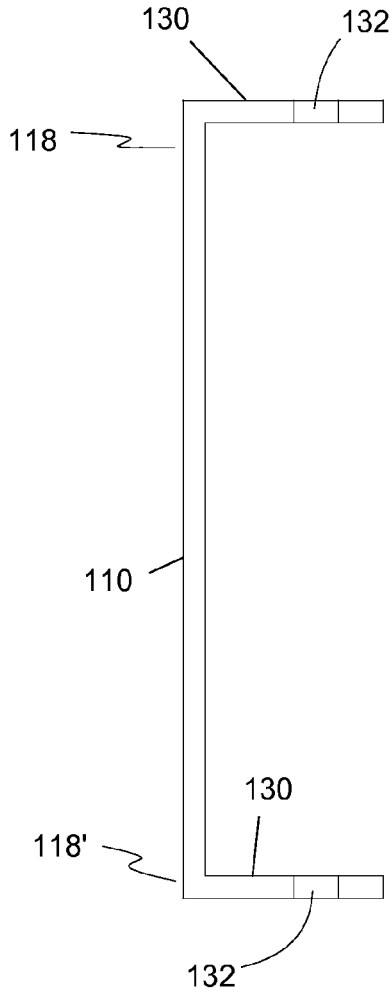
FIG. 17C is a rear view of the hinge plate in FIG. 15A.
Figure 17B:
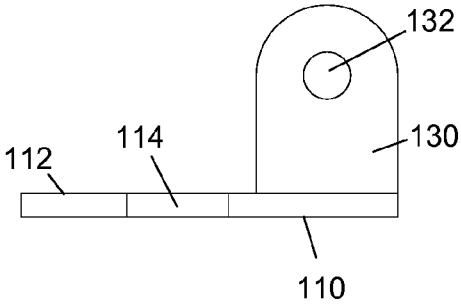
FIG. 17B is an end view of the hinge plate in FIG. 15A.

Turning now to FIG. 17A, there is illustrated a side view of a hinge plate 110 of the embodiment in FIG. 15A. Hinge plate 110 preferably includes a pair of linkage members 130 connected to first hinge plate end 118 and a second hinge plate end 118', a pair of support members 112 and a pair of hinge apertures 114 where each hinge aperture 114 is disposed in a corresponding support member 112. The optional notch 102 is located between the pair of support members 112. FIG. 17B is an end view of hinge plate 110 showing the linkage member 130. Linkage member 130 preferably has a linkage aperture 132 for receiving a linkage pin (not shown). FIG. 17C is a rear view of hinge plate 110. Each linkage member 130 extends away from the plane of hinge plate 110 in the same direction for a predefined distance. The length is typically sufficient to provide a pivot point spaced from the peripheral edge of the cover and cover flange that allows the cover to which hinge plate 110 is attached to pivot away from the cover flange.

Turning now to FIG. 18A, there is illustrated another embodiment of hinge plate 110. Hinge plate 110 includes all of the features previously discussed including the pair of linkage members 130, support members 112 and hinge apertures 114. Additionally, hinge plate 110 includes an optional inside plate stiffener 170. Inside plate stiffener 170 is a reinforcing component that is attached to hinge plate 110 and extends between linkage members 130. Inside plate stiffener 170 provides reinforcement support to both the hinge plate 110 and the linkage members 130. FIG. 18B shows an end view of hinge plate 110. Preferably, each linkage member 130 has a linkage aperture 132 for receiving a pivot pin (not shown) for connecting an overlapping linkage member 130 of hinge plate 110 with a corresponding linkage member 130 of hinge plate 120. Although inside plate stiffener 170 is shown as being positioned to the inside edge of linkage member 130, other placement alternatives between linkage members 130 are also possible and within the skill of one of ordinary skill in the art. FIG. 18C shows a rear view of hinge plate 110 and inside plate stiffener 118. Like the linkage members 130, inside plate stiffener 170 preferably extends out of the plane of hinge plate 110. The distance that inside plate stiffener 170 extends away from hinge plate 110 is illustrative only and it should be noted that inside plate stiffener 170 could extend the length of linkage members 130 or any length in between.

Figure 19:
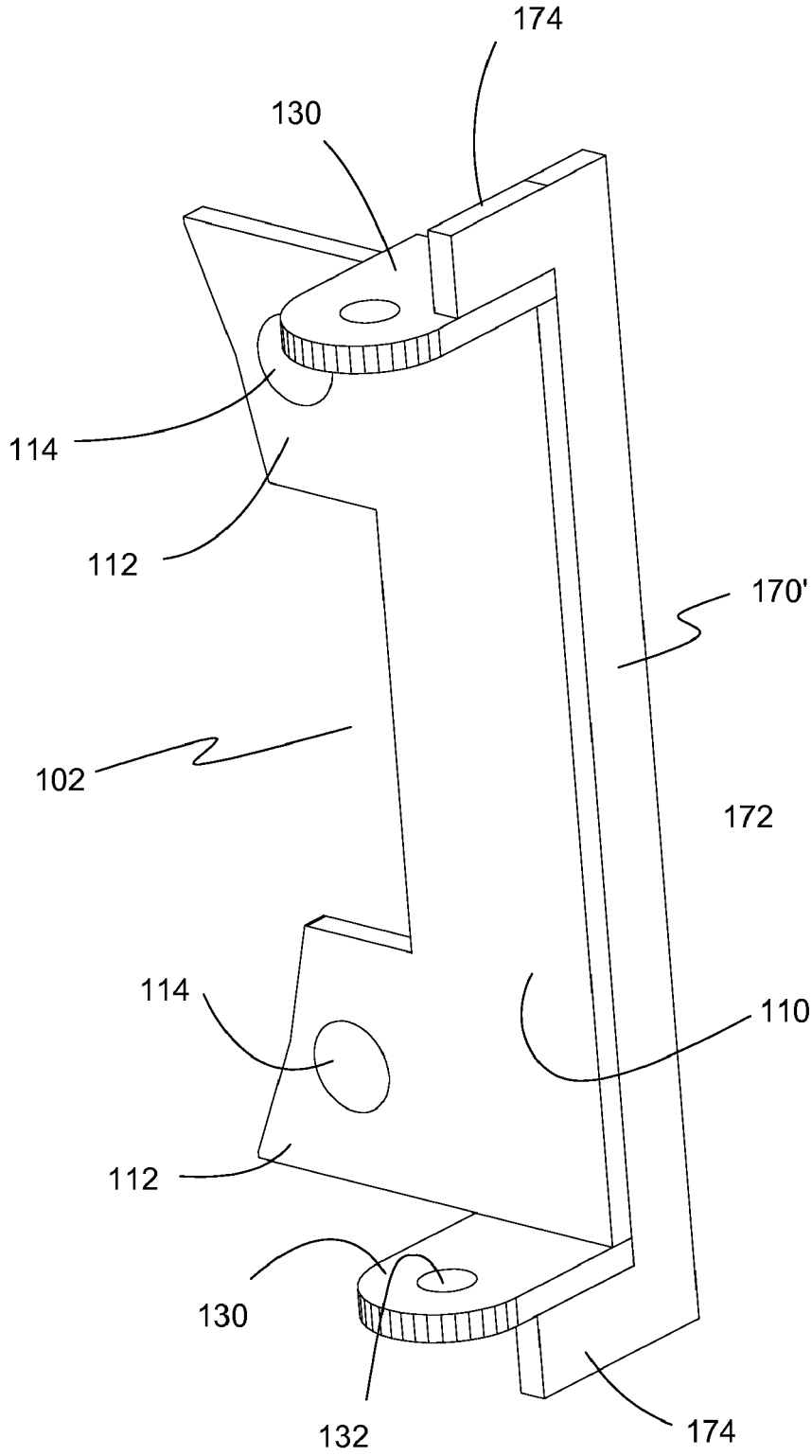
FIG. 19 is a perspective view of the hinge plate of the embodiment in FIG. 15A showing an external plate stiffener.

FIG. 19 illustrates hinge plate 110 with an outside plate stiffener 170'. Hinge plate 110 includes the support member 112 with hinge plate aperture 114 and linkage member 130. Outside plate stiffener 170' has a stiffener plate portion 172 that extends out of the plane of hinge plate 110 in an opposite direction as linkage member 130 and a stiffener linkage portion 174 that extends over linkage member 130. It should be understood that the illustrated position of outside plate stiffener 170' is not limiting. Outside plate stiffener 170' may be positioned such that stiffener linkage portion 174 extends over any area of linkage member 130 so long as outside plate stiffener 170' does not interfere with the pivot connection of hinge plate 110.

Figure 20:
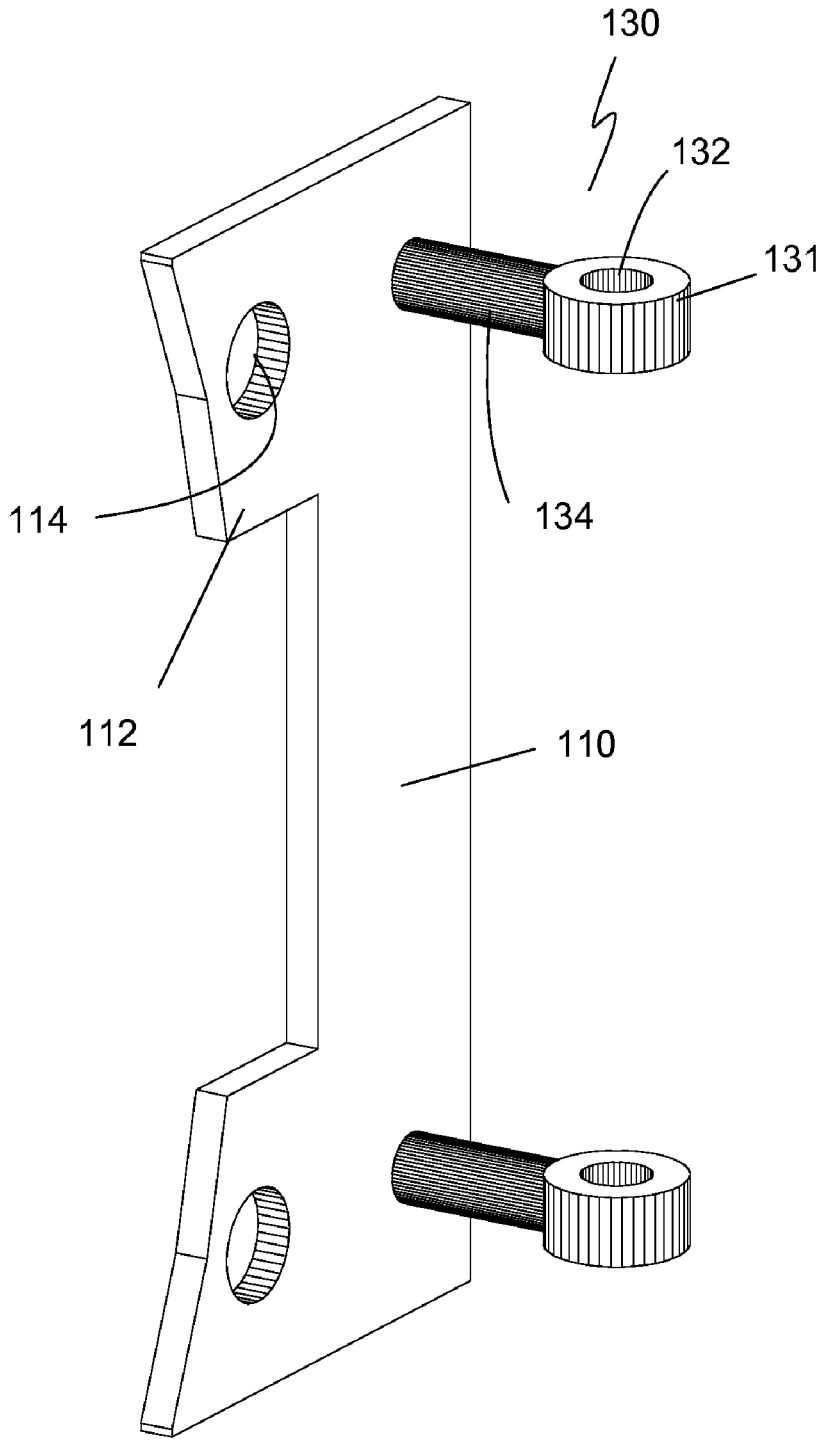
FIG. 20 is a perspective view of another embodiment of the linkage member of the hinge device of the present invention.

Turning now to FIG. 20, there is illustrated hinge plate 110 with an alternative embodiment of linkage member 130. Linkage member 130 includes a linkage spacer portion 134 and a linkage pivot portion 131. Linkage pivot portion 131 contains linkage aperture 132.

Figure 21:
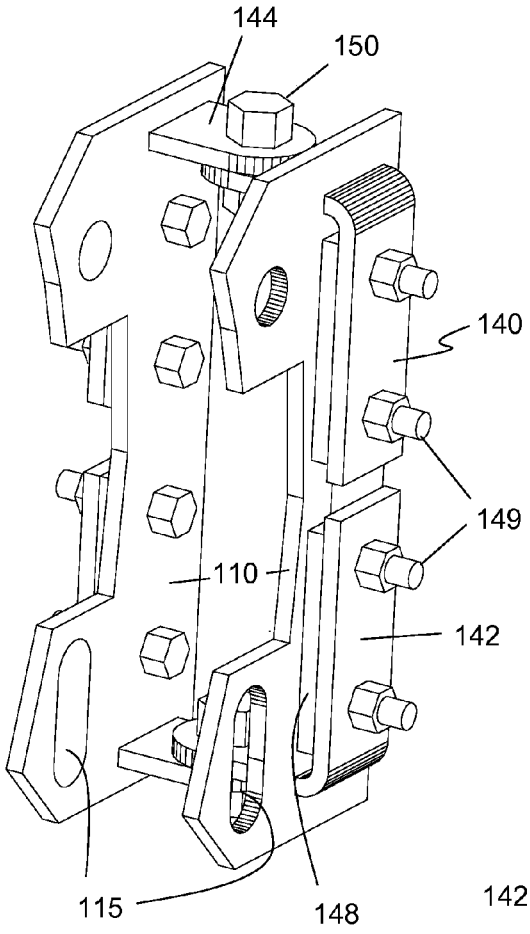
FIG. 21 is a perspective view of another embodiment of the present invention showing a hinge device with adjustable linkage members.

FIG. 21 illustrates a perspective view of another embodiment of hinge device 100. In this embodiment, hinge plates 110, 120 include an adjustable linkage member 140. Adjustable linkage member 140 includes a linkage member body 142 and a linkage member tab 144. An optional linkage member spacer 148 is also provided. Linkage member tab 144 is configured for receiving pivot connection 150. Linkage member spacer 148 is optionally positioned between hinge plate 110, 120 and linkage member body 142. Linkage member spacer 148 may be provided in a variety of thicknesses for adjusting the hinge pivot point based on the thickness of the cover and the cover flange. Also shown is optional hinge adjustment slot 115.

Figure 22:
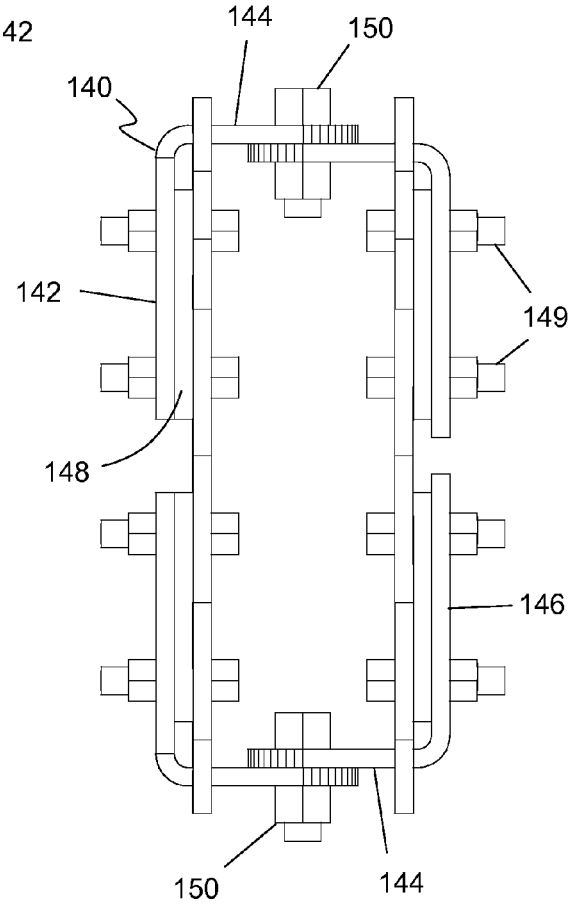
FIG. 22 is a front view of the embodiment shown in FIG. 21.

FIG. 22 is a front view of the embodiment of hinge device 100. As illustrated, a plurality of hinge tab fasteners 149 secures adjustable linkage member 140 and optional linkage member spacer 148 to hinge plates 110, 120. It should be recognized that the non-use of linkage member spacer 148 or the use of a linkage member spacer 148 having different thicknesses provides adjustment of the spatial position of pivot connection 150 relative to hinge plates 110, 120. This adjustment capability allows modification to hinge device 100 for covers and cover flanges of different thicknesses. It is noted that only one hinge plate may have the adjustable linkage member 140 while the other hinge plate has a fixed linkage member 130.

Figure 23:
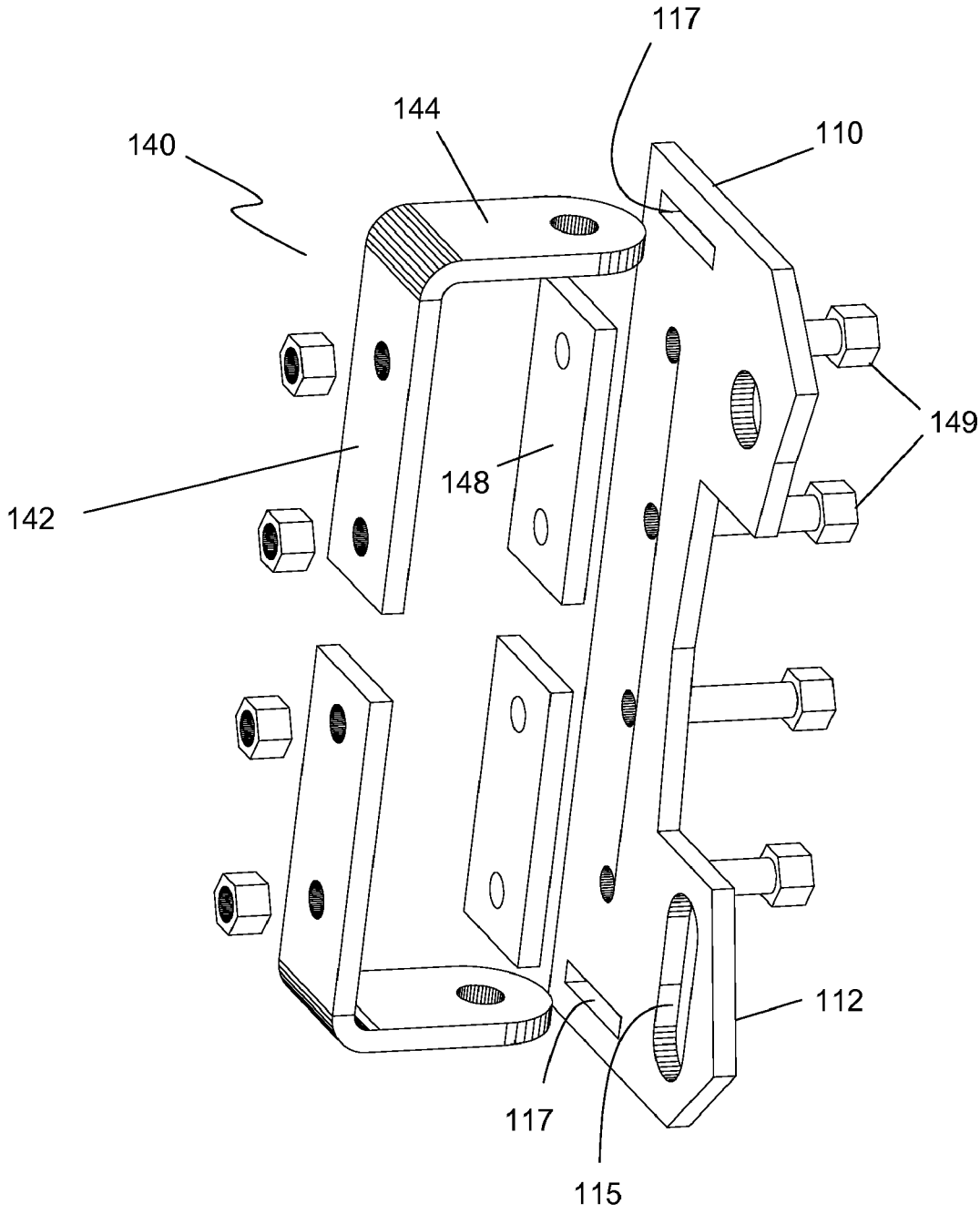
FIG. 23 is an exploded, perspective view of one half of the hinge device shown in FIG. 21.

Turning now to FIG. 23, there is illustrated and exploded view of hinge device 100 illustrated in FIGS. 21 and 22. As is more clearly shown, hinge plate 110 includes a linkage member slot 117. Linkage member slot 117 receives linkage member tab 142, which extends out of the plane of hinge plate 110. Optional linkage member spacer 148 provides a means for adjusting the distance that linkage member tab 142 extends away from hinge plate 110 and, thus, the relative position of pivot connection 150. If optional linkage member spacer 148 is not used, the relative position of pivot connection 150 is spaced further from hinge plate 110. When optional linkage member spacer 148 is used, the closer the relative position of pivot connection 150 is to hinge plate 110. The distance between pivot connection 150 and hinge plate 110 is determined by the thickness of linkage member spacer 148. It is preferable to use bolts as the plurality of hinge tab fasteners 149 for connecting adjustable linkage member 140 to hinge plate 110. In this embodiment, there is also illustrated an optional hinge adjustment slot 115 in hinge support 112 instead of the hinge aperture 114. Since the spacing between the holes in covers vary by both flange diameter and the number of bolt holes around the circumference of the flange, optional hinge adjustment slot 115 is provided to adjustability for multiple flange geometries.

Figure 24:
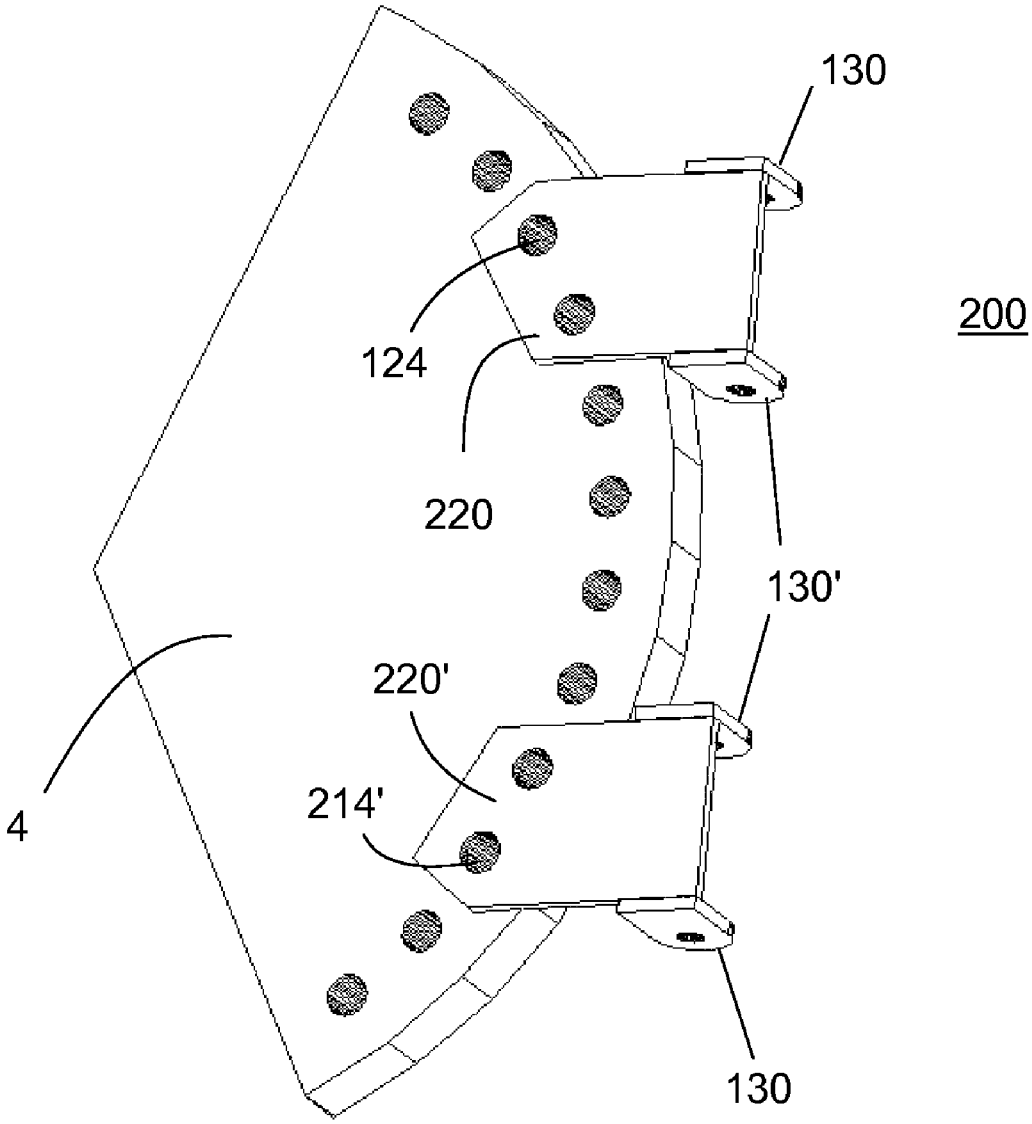
FIG. 24 is a perspective view of another embodiment of the present invention showing a split hinge device.

In situations where a relatively large cover is to be removed or a split cover is anticipated, a split hinge embodiment is contemplated. FIG. 24 illustrates one embodiment of a split hinge device 200 on a cover 4. Split hinge device 200 includes an upper hinge plate 220 and a lower hinge plate 220'. Upper hinge plate 220 and lower hinge plate 220' include a linkage member 130 and a hinge plate aperture 124. Upper hinge plate 220 and lower hinge plate 220' may optionally include a second linkage member 130'. Although only the cover hinge plates 220, 220' are illustrated, it is understood that the cover flange 2 would also have corresponding flange hinge plates with pivot connections connecting the flange hinge plates to the cover hinge plates.

In all of the embodiments of the present invention, pin 60 can be a bolt or pin. For example, pin 60 may be the existing studs or bolts from the manway cover 4 and manway cover flange 2, a close fit pin, a special bolt/pin with an interference fit at the flange hole and the cover hole, a bolt with threads configured to attach to a threaded pin receiving end 42 of support member 40, a tapered pin, an expandable plug, a bolt/pin that is eccentric or concentric to the flange hole and the cover hole and could be a loose or tight fit to the hole, or the cover hole could be threaded to receive a bolt.

One of the methods of using the hinge device 10 of FIGS. 1-14 of the present invention will now be explained. A plurality of bolts are removed from one portion of a manway cover 4. A support member 40 is inserted into each of the longitudinally-aligned apertures 22 of flange hinge member 20*a* and cover hinge member 20*b* such that pin receiving end 42 may be adjustably aligned with the bolt holes of the flange 2 and cover 4. A support member nut 44 is then loosely threaded on the opposite end of support member 40 of each support member 40 to prevent the separation of support member 40 from flange hinge member 20*a* and cover hinge member 20*b*. Linkage member 30 may be loosely connected to each end 21 of hinge members 20*a* and 20*b* or may be connected after hinge members 20*a* and 20*b* are connected to the flange 2 and cover 4, respectively. Because flange hinge member 20*a* is connected to the flange, flange hinge member 20*a* is considered the fixed hinge member. Linkage member 30 is pivotally connected to flange hinge member 20*a* and preferably fixedly connected to cover hinge member 20*b*.

Pin receiving ends 42 are aligned with the holes previously occupied by the flange/cover bolts. A pin 60 is inserted into each pin receiving end 42 and the bolt hole of flange 2 and cover 4 with which it is aligned. Each bolt hole will have two pins 60, one for the flange hole and one for the cover hole. The bolts that were removed from the cover may also be used as pins 60. Once inserted, support member nuts 44 are tightened drawing pin receiving ends 42 toward their respective hinge members 20*a*, 20*b*. This action causes the pins 60 to press against the bolt holes (particularly if unthreaded pins are used) and secures the hinge device 10 to the cover and flange. Once support member nuts 44 on support members 40 are sufficiently tightened and linkage member 30 securely attached (if not previously attached), the remaining manway cover bolts are removed and the cover is pivoted away from the flange. To reinstall the manway cover, the procedure is reversed. The cover is pivoted into position and a majority of the cover bolts are attached and secured before loosing the nuts 44 of support members 40 and disassembling hinge device 10. One of the many advantages of the present invention is the use of pins 60 to secure the hinge device 10 to the flange 2 and cover 4. This configuration facilitates alignment of cover 4 to flange 2 when re-installing cover 4 to flange 2.

It should be noted that the support members 40 uses a pulling-type pressure to cause the pins 60 to secure the cover and flange, i.e. the pins 60 are pulled toward hinge device 10. However, it should be understood that a pushing-type pressure can also be used by simply using a configuration such as a spacer rod. The spacer rod may be a rod, screw, bolt or any structure that acts as a spacer between the hinge members 22 and the peripheral edge of cover 4 and flange 2. An example of a preferred spacer rod is a Jack screw or expanding screw. When a Jack screw or expanding screw is used, the spacer rod also serves as a set screw. Examples of such a pushing type pressure are illustrated in US Pat. Appl. Pub. No. 2005/0242051 in FIGS. 25-32, which are incorporated herein by reference.

Locknuts may also be optionally incorporated into the present invention to prevent inadvertent loosening of the support members 40 during use. Various configurations are contemplated and are within the scope of the present invention, but each such configuration requires a support member 40 used in conjunction with a pin 60 for each cover hole and flange hole used to attach the present invention to the manway cover 4 and the manway flange 2.

Regarding the embodiments in FIGS. 15-24, a more simplified method will now be explained. A plurality of bolts are removed from one portion of a manway cover 4. A hinge plate 110 is positioned so that the hinge plate apertures 114 align with the bolt holes in the cover flange 2. In the event where the bolt holes in the cover flange 2 are blind holes or where they are unsuitable, additional holes may be formed into cover 4 and cover flange 2 that are suitable for use with the present invention. Because hinge plate 110 is connected to the flange, hinge plate 110 is considered the fixed hinge member. A pin 60 is inserted into each hinge plate aperture 114 and the bolt hole of flange 2. Likewise, a hinge plate 120 is positioned to correspond to hinge plate 110 so that the hinge plate apertures 124 align with the bolt holes in the cover 4. A pin 60 is also inserted into each hinge plate aperture 124 and the bolt hole of cover 4. Thus, each bolt hole will have two pins 60, one for the flange hole and one for the cover hole for connecting the hinge plates 110, 120 to the cover 4 and cover flange 2. It is also contemplated that each hinge plate may optionally have any number of hinge apertures to provide additional connection points to the cover and flange. Pins 60 are preferably expandable plugs or bolts. A pivot connection 150 may be attached to the overlapping and corresponding linkage members of hinge plates 110, 120 before attaching hinge plates 110, 120 to the cover and the cover flange or after attaching hinge plates 110, 120 to the cover and the cover flange. The preferred method is to connect hinge plates 110, 120 to each other using pivot connection 150 before attaching to the cover and cover flange. Once hinge plates 110, 120 are sufficiently secured to the cover and cover flange, the remaining manway cover bolts are removed and the cover is pivoted away from the flange.

To reinstall the manway cover, the procedure is reversed. The cover is pivoted into position and a majority of the cover bolts are attached and secured before removing pins 60 from hinge plates 110, 120 and disassembling hinge device 100. One of the many advantages of the present invention is the use of pins 60 to secure the hinge device 10 or 100 to the flange 2 and cover 4. This configuration facilitates alignment of cover 4 to flange 2 when re-installing cover 4 to flange 2. It is also contemplated that the present invention may also be left in place on cover 4 and flange 4 after reinstalling cover 4. To accomplish this, a longer stud is inserted through the hinge plate apertures of hinge plate 110 and corresponding hinge plate 120 and the cover and cover flange holes sufficient to attach stud nuts for securing the cover to the flange. To open cover 4 using hinge device 100, a user simply removes the stud nuts and the longer studs from the hinge apertures 114, 124 and re-inserts pins 60 before removing the remaining bolts from cover 4 and cover flange 2.

The present invention provides a simplified method and device for removing manway covers, as defined herein. The present invention is portable and capable of being installed and used by a single person. The various optional features provide, in a single device, the ability to accommodate multiple flange geometries in terms of cover diameters, bolt hole spacings and cover/cover flange thicknesses. Additionally, the present invention has relatively few component parts providing for a simple yet effective and easily assembled and transportable device for removing manway covers.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

What is claimed is:

1. A portable manway hinge device for handling the removal and installation of a manway cover, the hinge device adapted for attaching to a flange face of a manway flange having a planar face parallel to a manway opening, the manway flange having a plurality of transverse bolt openings, and a manway cover having a peripheral manway portion containing a plurality of bolt openings corresponding to the bolt openings of the manway flange, the hinge device comprising:

a pair of removable hinge plates, each hinge plate defining a longitudinal plane, wherein one of the pair of hinge plates has a support member parallel to the longitudinal plane with a hinge aperture adapted to align with one of the plurality of transverse bolt openings of the manway cover and the other of the pair of hinge plates has a support member parallel to the longitudinal plane with a hinge aperture adapted to align with one of the plurality of transverse bolt openings of the manway flange;

a linkage member adjacent a first end of each hinge plate of the pair of removable hinge plates and extending transversely out of the longitudinal plane of the hinge plate wherein the linkage member of one of the pair of hinge plates overlaps with the linkage member of the other of the pair of hinge plates; and a pivotal connection coupling overlapping pairs of the linkage member of the pair of hinge plates.

2. The hinge device of claim 1 wherein the linkage member is an adjustable linkage member having a linkage member body and a linkage member tab at one end of the linkage member body and extending out of the plane of the linkage member body wherein the linkage member tab extends through a linkage member slot in the hinge plate and the linkage member body is secured to the hinge plate.

3. The hinge device of claim 2 wherein the adjustable linkage member further includes an adjustment spacer positioned between the linkage member body and the hinge plate.

4. The hinge device of claim 1 wherein the hinge plate has a hinge plate notch adjacent the support member.

5. The hinge device of claim 1 wherein the hinge plate is a split hinge plate having an upper hinge support and a lower hinge support wherein each of the upper hinge support and the lower hinge support has a linkage member.

6. The hinge device of claim 5 wherein the upper hinge support has a second linkage member extending from the plane of the upper hinge support at a second end and aligned with the linkage member extending from the first end.

7. The hinge device of claim 1 wherein the pivotal connection is a hinge pin.

8. The hinge device of claim 1 wherein the hinge plate has a plate stiffener extending transversely out of the plane of the hinge plate along a substantial portion of the hinge plate.

9. The hinge device of claim 8 wherein the plate stiffener is an internal plate stiffener positioned along the inside of the hinge plate.

10. The hinge device of claim 8 wherein the plate stiffener is an external plate stiffener positioned along the outside of the hinge plate.

11. The hinge device of claim 10 wherein the external plate stiffener extends over a portion of the linkage member.

12. A method of handling the removal and installation of a manway cover to a manway flange, the manway flange having a planar face parallel to a manway opening and a plurality of transverse bolt openings, and the manway cover having a peripheral manway portion containing a plurality of bolt openings corresponding to the bolt openings of the manway flange, the method comprising:

removing a plurality of manway cover bolts from a portion of the manway cover and the manway flange, the plurality of manway cover bolts being transverse to the plane of and through the manway cover;

assembling a portable manway cover hinge device having a pair of hinge plates, each hinge plate defining a longitudinal plane, wherein each hinge plate has a support member parallel to the longitudinal plane with a hinge aperture adapted to align with a bolt opening of a manway cover and a bolt opening of a manway flange, a linkage member adjacent a first end of each hinge plate and extending transversely out of the longitudinal plane of the hinge plate, and a pivotal connection coupling overlapping pairs of the linkage member of the pair of hinge plates;

aligning a hinge aperture of the support member of one of the pair of hinge plates with one of the plurality of bolt openings of the portion of the manway cover and aligning a hinge aperture of the support member of the other of the pair of hinge plates with one of the plurality of bolt openings of the portion of the manway flange from which the bolts were removed;

inserting a pin into each hinge aperture of one of the pair of hinge plates and corresponding manway cover bolt opening and a pin into each hinge aperture of the other of the pair of hinge plates and corresponding manway flange bolt opening;

securing each pin within the corresponding cover bolt opening and flange bolt opening; and removing the remaining manway cover bolts from the manway cover.

13. The method of claim 12 wherein assembling step includes assembling a pair of hinge plates wherein one of the pair of hinge plates is a flange hinge member, the other of the pair of hinge plates is a cover hinge member and wherein the support member is slidably connected to the flange hinge member and the cover hinge member.

14. The method of claim 13 wherein the pin securing step includes drawing each pin towards the manway hinge cover device until the manway cover hinge device is securely connected to the manway cover and the manway flange.

15. The method of claim 13 wherein the removing step includes swinging the manway cover about the manway cover hinge device.

16. A method of handling the removal and installation of a manway cover to a manway flange, the manway flange having a planar face parallel to a manway opening and a plurality of transverse bolt openings, and the manway cover having a peripheral manway portion containing a plurality of bolt openings corresponding to the bolt openings of the manway flange, the method comprising:

removing a plurality of manway cover bolts from a portion of the manway cover and the manway flange exposing a plurality of bolt openings;

assembling a portable manway cover hinge device having a pair of hinge plates, each hinge plate defining a longitudinal plane, wherein each hinge plate has a support member parallel to the longitudinal plane with a hinge aperture adapted to align with one of the plurality of bolt openings of the manway cover and the manway flange, a linkage member adjacent a first end of each hinge plate and extending out of and transverse to the longitudinal plane of the hinge plate, and a pivotal connection coupling overlapping pairs of the linkage member of the pair of hinge plates;

aligning a hinge aperture of the support member of one of the pair of hinge plates with one of the plurality of bolt openings of the portion of the manway cover and aligning a hinge aperture of the support member of the other of the pair of hinge plates with one of the plurality of bolt openings of the portion of the manway flange from which the bolts were removed;

inserting a pin into each hinge aperture of one of the pair of hinge plates and corresponding manway cover bolt opening and a pin into each hinge aperture of the other of the pair of hinge plates and corresponding manway flange bolt opening;

securing each pin within the corresponding cover bolt opening and flange bolt opening; and removing the remaining manway cover bolts from the manway cover.

17. In combination, a manway cover connected to a manway flange having a planar face parallel to a manway opening, the manway flange having a plurality of transverse bolt openings, and a manway cover having a peripheral manway portion containing a plurality of bolt openings corresponding to the bolt openings of the manway flange wherein each of the plurality of corresponding bolt openings has a bolt inserted into each of the plurality of aligned bolt openings of the manway cover and the manway flange and a portable manway hinge device for handling the removal and installation of the manway cover, the combination comprising:

a manway cover connected to a manway flange wherein a predetermined number of the plurality of bolts have been removed; and a portable manway hinge device connected to the manway cover and manway flange where the predetermined number of the plurality of bolts have been removed, the hinge device comprising:

a pair of hinge plates, each hinge plate defining a longitudinal plane, wherein one hinge plate has a support member parallel to the longitudinal plane with a hinge aperture aligned with a bolt opening of the manway cover and wherein the other hinge plate has a support member parallel to the longitudinal plane with a hinge aperture aligned with a bolt opening of the cover flange;

a removable pin inserted into the hinge aperture aligned with the bolt opening of the manway cover and a removable pin inserted into the hinge aperture aligned with the bolt opening of the cover flange.

a linkage member adjacent a first end of each hinge plate and extending transversely out of the longitudinal plane of the hinge plate toward and overlapping with the other hinge plate; and a pivotal connection coupling overlapping pairs of the linkage member of the pair of hinge plates.

18. The combination of claim 17 wherein the linkage member is an adjustable linkage member having a linkage member body and a linkage member tab at one end of the linkage member body and extending out of the plane of the linkage member body wherein the linkage member tab extends through a linkage member slot in the hinge plate and the linkage member body is secured to the hinge plate.

19. The combination of claim 18 wherein the adjustable linkage member further includes an adjustment spacer positioned between the linkage member body and the hinge plate.

20. The combination of claim 17 wherein the hinge plate has a hinge plate notch adjacent the support member.

21. The combination of claim 17 wherein the hinge plate is a split hinge plate having an upper hinge support and a lower hinge support wherein each of the upper hinge support and the lower hinge support has a linkage member.

22. The combination of claim 21 wherein the upper hinge support has a second linkage member extending from the plane of the upper hinge support at a second end and aligned with the linkage member extending from the first end.

23. The combination of claim 17 wherein the pivotal connection is a hinge pin.

24. The combination of claim 17 wherein the hinge plate has a plate stiffener extending transversely out of the plane of the hinge plate along a substantial portion of the hinge plate.

25. The combination of claim 24 wherein the plate stiffener is an internal plate stiffener positioned along the inside of the hinge plate.

26. The combination of claim 24 wherein the plate stiffener is an external plate stiffener positioned along the outside of the hinge plate.

27. The combination of claim 26 wherein the external plate stiffener extends over a portion of the linkage member.

* * * * *